US008409368B2

(12) United States Patent
Ushigami et al.

(10) Patent No.: US 8,409,368 B2
(45) Date of Patent: Apr. 2, 2013

(54) MANUFACTURING METHOD OF GRAIN-ORIENTED MAGNETIC STEEL SHEET

(75) Inventors: Yoshiyuki Ushigami, Tokyo (JP); Norikazu Fujii, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/261,144

(22) PCT Filed: Jul. 15, 2010

(86) PCT No.: PCT/JP2010/061938

§ 371 (c)(1), (2), (4) Date: Jan. 13, 2012

(87) PCT Pub. No.: WO2011/007817

PCT Pub. Date: Jan. 20, 2011

(65) Prior Publication Data

US 2012/0111455 A1 May 10, 2012

(30) Foreign Application Priority Data

Jul. 17, 2009 (JP) ..... 2009-168974
Jul. 17, 2009 (JP) ..... 2009-169011
Jan. 26, 2010 (JP) ..... 2010-014724

(51) Int. Cl.
*H01F 1/147* (2006.01)
*H01F 1/18* (2006.01)

(52) U.S. Cl. ..... 148/113

(58) Field of Classification Search ..... None
See application file for complete search history.

(56) References Cited

U.S. PATENT DOCUMENTS 3,905,842 A 9/1975 Grenoble
3,905,843 A 9/1975 Fiedler
3,932,234 A 1/1976 Imanaka et al.
4,929,286 A 5/1990 Komatsu et al.
4,979,997 A 12/1990 Kobayashi et al.
4,994,120 A 2/1991 Takahashi et al.
5,186,762 A 2/1993 Ushigami et al.
(Continued)

FOREIGN PATENT DOCUMENTS

JP 30-3651 5/1955
JP 33-4710 6/1958
(Continued)

OTHER PUBLICATIONS

International Search Report dated Sep. 14, 2010 issued in corresponding PCT Application No. PCT/JP2010/061938.

(Continued)

*Primary Examiner* — John Sheehan
(74) *Attorney, Agent, or Firm* — Kenyon & Kenyon LLP

(57) ABSTRACT

A nitriding treatment (Step S6) in which an N content of a decarburization-annealed steel strip is increased is performed between start of a decarburization annealing (Step S4) and occurrence of secondary recrystallization in a finish annealing (Step S5). In hot rolling (Step S1), a silicon steel material is held in a temperature range between 1000° C. and 800° C. for 300 seconds or longer, and then finish rolling is performed.

25 Claims, 6 Drawing Sheets

U.S. PATENT DOCUMENTS

| | | | | |
|---|---|---|---|---|
| 5,885,371 | A | 3/1999 | Komatsubara et al. | |
| 6,331,215 | B1 * | 12/2001 | Toge et al. | 148/111 |
| 6,432,222 | B2 | 8/2002 | Ohata et al. | |
| 6,444,051 | B2 | 9/2002 | Komatsubara et al. | |
| 7,976,645 | B2 | 7/2011 | Ushigami et al. | |
| 2002/0007870 | A1 | 1/2002 | Ohata et al. | |
| 2002/0011278 | A1 | 1/2002 | Komatsubara et al. | |
| 2009/0126832 | A1 * | 5/2009 | Ushigami et al. | 148/208 |
| 2012/0103474 | A1 * | 5/2012 | Ushigami et al. | 148/208 |
| 2012/0111455 | A1 | 5/2012 | Ushigami et al. | |

FOREIGN PATENT DOCUMENTS

| | | |
|---|---|---|
| JP | 51-13469 | 4/1976 |
| JP | 57-207114 | 12/1982 |
| JP | 62-45285 | 9/1987 |
| JP | 1-230721 | 9/1989 |
| JP | 1-283324 | 11/1989 |
| JP | 02-258929 | 10/1990 |
| JP | 3-2324 | 1/1991 |
| JP | 10-140243 | 5/1998 |
| JP | 11-050153 | 2/1999 |
| JP | 11-335736 | 12/1999 |
| JP | 2000-129352 | 5/2000 |
| JP | 2000-282142 | 10/2000 |
| JP | 2001-152250 | 6/2001 |
| JP | 2002-348611 | 12/2002 |

OTHER PUBLICATIONS

May et al., "Secondary Recrystallization in Silicon Iron", Transactions of the Metallurgical Society of AIME, 212(1958) p. 769-781.

Saito, "Effect of Minor Elemens on Normal Grain Growth Rate in Singly Oriented Si-Steel", Journal of the Japan Institute of Metals 27 (1963) p. 186-191.

Matsuoka, "Effect of Impurities on the Secondary Recrystallization in Silicon Iron", Tetsu-to-Hagane 53(1967) p. 1007-1023.

Kuroki et al., "Inhibitors for Grain Oriented Silicon Steel", Journal of the Japan Institute of Metals 43 (1979) p. 175-181.

Kuroki et al., "Effect of Precipitation Annealing on the (110) [001] Secondary Recrystallization of 3% Si-Fe", Journal of the Japan Institute of Metals 44 (1980) p. 419-424.

Ushigami et al., "Precipitation Behaviors of Injected Nitride Inhibitors during Secondary Recrystallization Annealing in Grain Oriented Silicon Steel", Materials Science Forum vols. 204-206 (1996) p. 593-598.

Grenoble, "The Role of Solutes in the Secondary Recrystallization of Silicon Iron", IEEE Transactions on Magnetics vol. MAG-13, No. 5, Sep. 1977, p. 1427-1432.

International Preliminary Report on Patentability dated Feb. 16, 2012 issued in corresponding PCT Application No. PCT/JP2010/061938.

Non-Final Office Action dated Jun. 12, 2012 issued in corresponding U.S. Appl. No. 13/381,294.

* cited by examiner

MANUFACTURING METHOD OF GRAIN-ORIENTED MAGNETIC STEEL SHEET

This application is a national stage application of International Application No. PCT/JP2010/061938, filed 15 Jul. 2010, which claims priority to Japanese Application Nos. 2009-168974, filed 17 Jul. 2009; 2009-169011, filed 17 Jul. 2009; and 2010-014724, filed 26 Jan. 2010, each of which is incorporated by reference in its entirety.

TECHNICAL FIELD

The present invention relates to a manufacturing method of a grain-oriented magnetic steel sheet suitable for an iron core or the like of an electrical apparatus.

BACKGROUND ART

A grain-oriented electrical steel sheet is a soft magnetic material, and is used for an iron core or the like of an electrical apparatus such as a transformer (trans.). In the grain-oriented electrical steel sheet, Si of about 7 mass % or less is contained. Crystal grains of the grain-oriented electrical steel sheet are highly integrated in the {110} <001> orientation by Miller indices. The orientation of the crystal grains is controlled by utilizing a catastrophic grain growth phenomenon called secondary recrystallization.

For controlling the secondary recrystallization, it is important to adjust a structure (primary recrystallization structure) obtained by primary recrystallization before the secondary recrystallization and to adjust a fine precipitate called an inhibitor or a grain boundary segregation element. The inhibitor has a function to preferentially grow, in the primary recrystallization structure, the crystal grains in the {110} <001> orientation and suppress growth of the other crystal grains.

Then, conventionally, there have been made various proposals aimed at precipitating an inhibitor effectively.

However, in conventional techniques, it has been difficult to manufacture a grain-oriented electrical steel sheet having a high magnetic flux density industrially stably.

Citation List

Patent Literature

Patent Literature 1: Japanese Examined Patent Application Publication No. 30-003651

Patent Literature 2: Japanese Examined Patent Application Publication No. 33-004710

Patent Literature 3: Japanese Examined Patent Application Publication No. 51-013469

Patent Literature 4: Japanese Examined Patent Application Publication No. 62-045285

Patent Literature 5: Japanese Laid-open Patent Publication No. 03-002324

Patent Literature 6: U.S. Pat. No. 3,905,842

Patent Literature 7: U.S. Pat. No. 3,905,843

Patent Literature 8: Japanese Laid-open Patent Publication No. 01-230721

Patent Literature 9: Japanese Laid-open Patent Publication No. 01-283324

Patent Literature 10: Japanese Laid-open Patent Publication No. 10-140243

Patent Literature 11: Japanese Laid-open Patent Publication No. 2000-129352

Patent Literature 12: Japanese Laid-open Patent Publication No. 11-050153

Patent Literature 13: Japanese Laid-open Patent Publication No. 2001-152250

Patent Literature 14: Japanese Laid-open Patent Publication No. 2000-282142

Patent Literature 15: Japanese Laid-open Patent Publication No. 11-335736

Non Patent Literature

Non Patent Literature 1: "Trans. Met. Soc. AIME", 212, pp. 769/781, 1958

Non Patent Literature 2: "J. Japan Inst. Metals", 27, p. 186, 1963

Non Patent Literature 3: "Tetsu-to-Hagane (Iron and Steel) ",53, pp. 1007/1023, 1967

Non Patent Literature 4: "J. Japan Inst. Metals", 43, pp. 175/181, 1979 and "J. Japan Inst. Metals", 44, pp. 419/424, 1980

Non Patent Literature 5: "Materials Science Forum", 204-206, pp. 593/598, 1996

Non Patent Literature 6: "IEEE Trans. Mag.", MAG-13, p. 1427

SUMMARY OF THE INVENTION

Technical Problem

The present invention has an object to provide a manufacturing method of an grain-oriented magnetic steel sheet, the method enabling industrially stable production of an grain-oriented magnetic steel sheet having a high magnetic flux density.

Solution to Problem

A manufacturing method of a grain-oriented electrical steel sheet according to a first aspect of the present invention includes: hot rolling a silicon steel material so as to obtain a hot-rolled steel strip, the silicon steel material containing Si: 0.8 mass % to 7 mass %, acid-soluble Al: 0.01 mass % to 0.065 mass %, N: 0.004 mass % to 0.012 mass %, Mn: 0.05 mass % to 1 mass %, and B: 0.0005 mass % to 0.0080 mass %, the silicon steel material further containing at least one element selected from a group consisting of S and Se being 0.003 mass % to 0.015 mass % in total amount, a C content being 0.085 mass % or less, and a balance being composed of Fe and inevitable impurities; annealing the hot-rolled steel strip so as to obtain an annealed steel strip; cold rolling the annealed steel strip one time or more so as to obtain a cold-rolled steel strip; decarburization annealing the cold-rolled steel strip so as to obtain a decarburization-annealed steel strip in which primary recrystallization is caused; coating an annealing separating agent containing MgO as its main component on the decarburization-annealed steel strip; and causing secondary recrystallization by finish annealing the decarburization-annealed steel strip, wherein the method further includes performing a nitriding treatment in which an N content of the decarburization-annealed steel strip is increased between start of the decarburization annealing and occurrence of the secondary recrystallization in the finish annealing, the hot rolling includes: holding the silicon steel material in a temperature range between 1000° C. and 800° C. for 300 seconds or longer; and then performing finish rolling.

A manufacturing method of a grain-oriented electrical steel sheet according to a second aspect of the present invention, in the method according to the first aspect, further includes heating the silicon steel material at a predetermined temperature which is a temperature T1 (° C.) or lower before the hot rolling, in a case when no Se is contained in the silicon steel material, the temperature T1 being expressed by equation (1) below.

$$T1=14855/(6.82-\log([Mn]\times[S]))-273 \quad (1)$$

Here, [Mn] represents a Mn content (mass %) of the silicon steel material, and [S] represents an S content (mass %) of the silicon steel material.

A manufacturing method of a grain-oriented electrical steel sheet according to a third aspect of the present invention, in the method according to the first aspect, further includes heating the silicon steel material at a predetermined temperature which is a temperature T2 (° C.) or lower before the hot rolling, in a case when no S is contained in the silicon steel material, the temperature T2 being expressed by equation (2) below.

$$T2=10733/(4.08-\log([Mn]\times[Se]))-273 \quad (2)$$

Here, [Mn] represents a Mn content (mass %) of the silicon steel material, and [Se] represents an Se content (mass %) of the silicon steel material.

A manufacturing method of a grain-oriented electrical steel sheet according to a fourth aspect of the present invention, in the method according to the first aspect, further includes heating the silicon steel material at a predetermined temperature which is a temperature T1 (° C.) or lower and a temperature T2 (° C.) or lower before the hot rolling, in a case when S and Se are contained in the silicon steel material, the temperature T1 being expressed by equation (1), and the temperature T2 being expressed by equation (2).

In a manufacturing method of a grain-oriented electrical steel sheet according to a fifth aspect of the present invention, in the method according to any one of the first to the fourth aspects, the nitriding treatment is performed under a condition that an N content [N] of a steel strip obtained after the nitriding treatment satisfies inequation (3) below.

$$[N]\square 14/27[Al]+14/11[B]+14/47[Ti] \quad (3)$$

Here, [N] represents the N content (mass %) of the steel strip obtained after the nitriding treatment, [Al] represents an acid-soluble Al content (mass %) of the steel strip obtained after the nitriding treatment, [B] represents a B content (mass %) of the steel strip obtained after the nitriding treatment, and [Ti] represents a Ti content (mass %) of the steel strip obtained after the nitriding treatment.

In a manufacturing method of a grain-oriented electrical steel sheet according to a sixth aspect of the present invention, in the method according to any one of the first to the fourth aspects, the nitriding treatment is performed under a condition that an N content [N] of a steel strip obtained after the nitriding treatment satisfies inequation (4) below.

$$[N]\square 2/3[Al]+14/11[B]+14/47[Ti] \quad (4)$$

Here, [N] represents the N content (mass %) of the steel strip obtained after the nitriding treatment, [Al] represents an acid-soluble Al content (mass %) of the steel strip obtained after the nitriding treatment, [B] represents a B content (mass %) of the steel strip obtained after the nitriding treatment, and [Ti] represents a Ti content (mass %) of the steel strip obtained after the nitriding treatment.

Advantageous Effects of Invention

According to the present invention, it is possible to make BN precipitate compositely on MnS and/or MnSe appropriately and to form appropriate inhibitors, so that a high magnetic flux density can be obtained. Further, these processes can be executed industrially stably.

DESCRIPTION OF EMBODIMENTS

Figure 1:
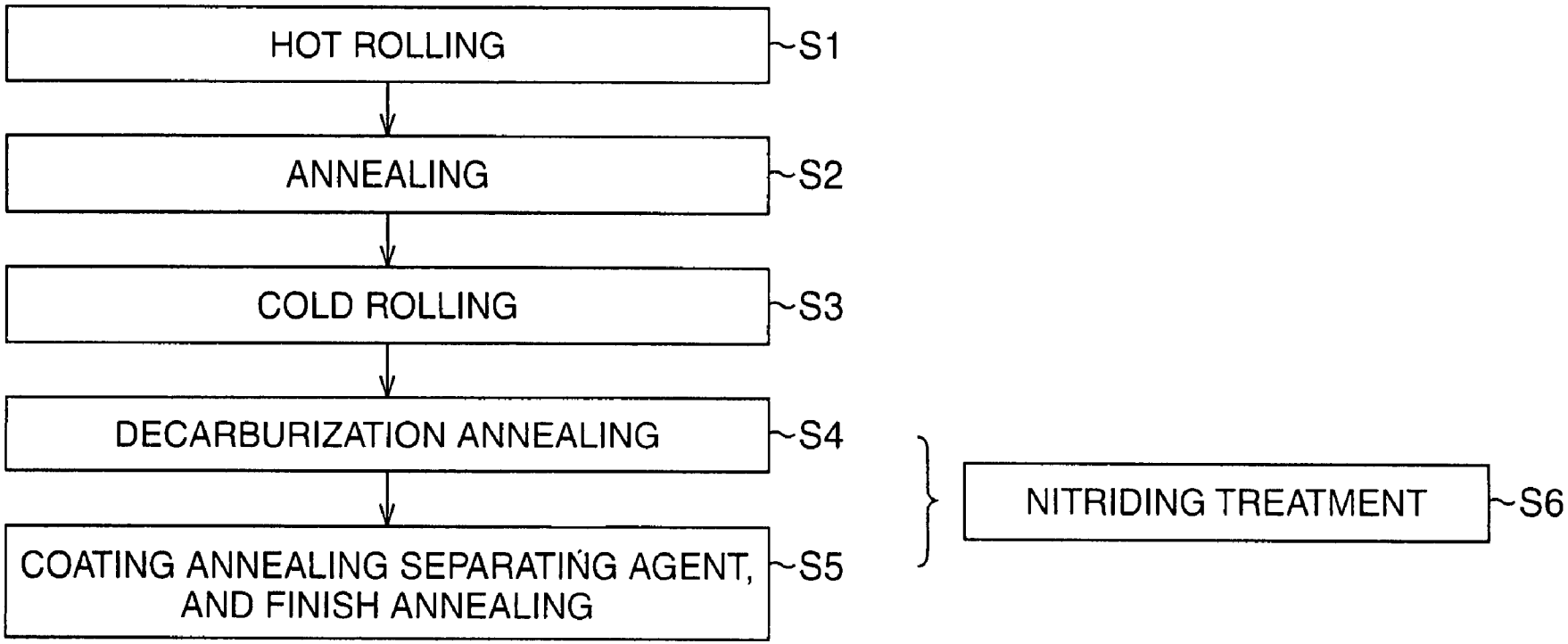
FIG. 1 is a flow chart showing a manufacturing method of a grain-oriented electrical steel sheet.

The present inventors thought that in the case of manufacturing a grain-oriented electrical steel sheet from a silicon steel material having a predetermined composition containing B, a precipitated form of B may affect behavior of secondary recrystallization, and thus conducted various experiments. Here, an outline of a manufacturing method of a grain-oriented electrical steel sheet will be explained. FIG. 1 is a flow chart showing the manufacturing method of the grain-oriented electrical steel sheet.

First, as illustrated in FIG. 1, in step S1, a silicon steel material (slab) having a predetermined composition containing B is subjected to hot rolling. By the hot rolling, a hot-rolled steel strip is obtained. Thereafter, in step S2, annealing of the hot-rolled steel strip is performed to normalize a structure in the hot-rolled steel strip and to adjust precipitation of inhibitors. By the annealing, an annealed steel strip is obtained. Subsequently, in step S3, cold rolling of the annealed steel strip is performed. The cold rolling may be performed only one time, or may also be performed a plurality of times with intermediate annealing being performed therebetween. By the cold rolling, a cold-rolled steel strip is obtained. Incidentally, in the case of the intermediate annealing being performed, it is also possible to omit the annealing of the hot-rolled steel strip before the cold rolling to perform the annealing (step S2) in the intermediate annealing. That is, the annealing (step S2) may be performed on the hot-rolled steel strip, or may also be performed on a steel strip obtained after being cold rolled one time and before being cold rolled finally.

After the cold rolling, in step S4, decarburization annealing of the cold-rolled steel strip is performed. In the decarburization annealing, primary recrystallization occurs. Further, by the decarburization annealing, a decarburization-annealed steel strip is obtained. Next, in step S5, an annealing separating agent containing MgO (magnesia) as its main component is coated on the surface of the decarburization-annealed steel strip and finish annealing is performed. In the finish annealing, secondary recrystallization occurs, and a glass film containing forsterite as its main component is formed on the surface of the steel strip and is purified. As a result of the secondary recrystallization, a secondary recrystallization structure arranged in the Goss orientation is obtained. By the finish annealing, a finish-annealed steel strip is obtained. Further, between start of the decarburization annealing and occurrence of the secondary recrystallization in the finish annealing, a nitriding treatment in which a nitrogen amount of the steel strip is increased is performed (step S6).

In this manner, the grain-oriented electrical steel sheet can be obtained.

Further, details will be described later, but as the silicon steel material, there is used one containing Si: 0.8 mass % to 7 mass %, acid-soluble Al: 0.01 mass % to 0.065 mass %, N: 0.004 mass % to 0.012 mass %, and Mn: 0.05 mass % to 1 mass %, and further containing predetermined amounts of S and/or Se, and B, a C content being 0.085 mass % or less, and a balance being composed of Fe and inevitable impurities.

Then, as a result of the various experiments, the present inventors found that it is important to adjust conditions of the hot rolling (step S1) to thereby generate precipitates in a form effective as inhibitors in the hot-rolled steel strip. Concretely, the present inventors found that when B in the silicon steel material precipitates mainly as BN precipitates compositely on MnS and/or MnSe by adjusting the conditions of the hot rolling, the inhibitors are thermally stabilized and grains of a grain structure of the primary recrystallization are finely arranged. Then, the present inventors obtained the knowledge capable of manufacturing the grain-oriented electrical steel sheet having a good magnetic property stably, and completed the present invention.

Here, the experiments conducted by the present inventors will be explained.

(First Experiment)

In the first experiment, first, various silicon steel slabs containing Si: 3.3 mass %, C: 0.06 mass %, acid-soluble Al: 0.027 mass %, N: 0.008 mass %, Mn: 0.05 mass % to 0.19 mass %, S: 0.007 mass %, and B: 0.0010 mass % to 0.0035 mass %, and a balance being composed of Fe and inevitable impurities were obtained. Next, the silicon steel slabs were heated at a temperature of 1100° C. to 1250° C. and were subjected to hot rolling. In the hot rolling, rough rolling was performed at 1050° C. and then finish rolling was performed at 1000° C., and thereby hot-rolled steel strips each having a thickness of 2.3 mm were obtained. Then, cooling water was jetted onto the hot-rolled steel strips to then let the hot-rolled steel strips cool down to 550° C., and thereafter the hot-rolled steel strips were cooled down in the atmosphere. Subsequently, annealing of the hot-rolled steel strips was performed. Next, cold rolling was performed, and thereby cold-rolled steel strips each having a thickness of 0.22 mm were obtained. Thereafter, the cold-rolled steel strips were heated at a speed of 15° C./s, and were subjected to decarburization annealing at a temperature of 840° C., and thereby decarburization-annealed steel strips were obtained. Subsequently, the decarburization-annealed steel strips were annealed in an ammonia containing atmosphere to increase nitrogen in the steel strips up to 0.022 mass %. Next, an annealing separating agent containing MgO as its main component was coated on the steel strips and finish annealing was performed. In this manner, various samples were manufactured.

Figure 2:
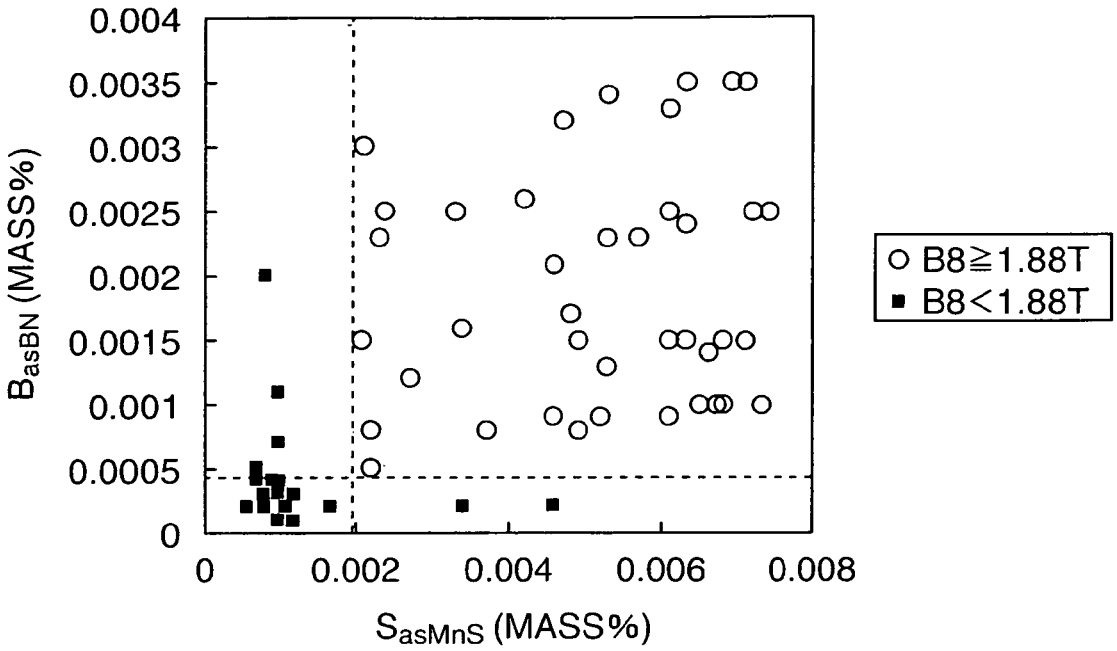
FIG. 2 is a view showing a result of a first experiment (a relationship between precipitates in a hot-rolled steel strip and a magnetic property after finish annealing)

Then, a relationship between precipitates in the hot-rolled steel strip and a magnetic property after the finish annealing was examined. A result of the examination is illustrated in FIG. 2. In FIG. 2, the horizontal axis indicates a value (mass %) obtained by converting a precipitation amount of MnS into an amount of S, and the vertical axis indicates a value (mass %) obtained by converting a precipitation amount of BN into B. The horizontal axis corresponds to an amount of S that has precipitated as MnS (mass %). Further, white circles each indicate that a magnetic flux density B8 was 1.88 T or more, and black squares each indicate that the magnetic flux density B8 was less than 1.88 T. As illustrated in FIG. 2, in the samples each having the precipitation amounts of MnS and BN each being less than a certain value, the magnetic flux density B8 was low. This indicates that secondary recrystallization was unstable.

Figure 3:
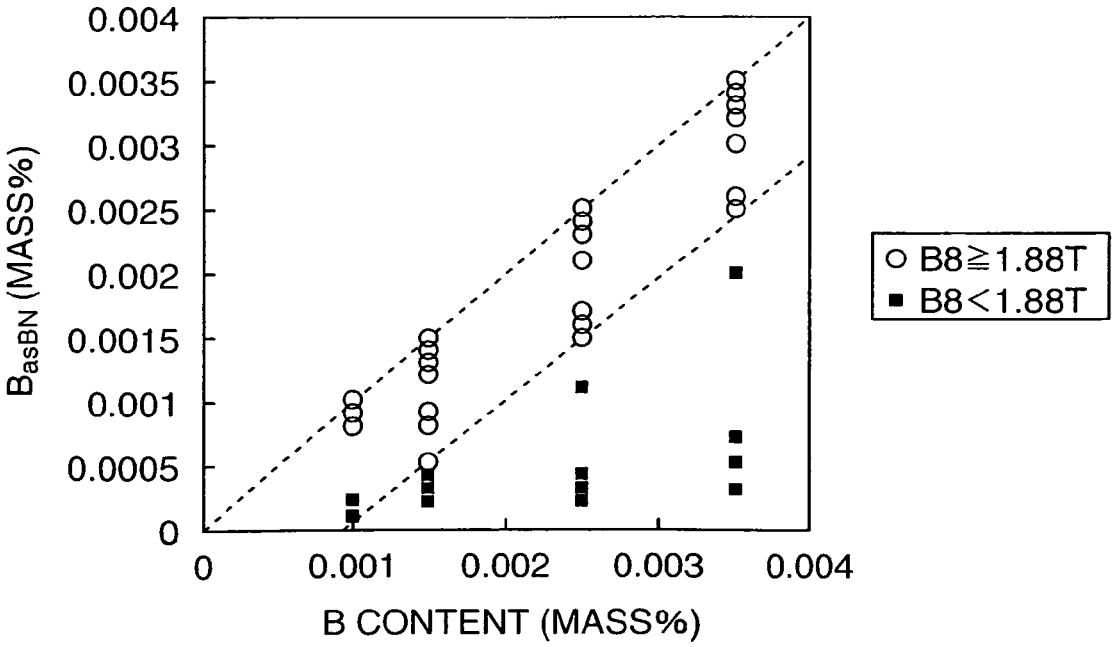
FIG. 3 is a view showing the result of the first experiment (a relationship between an amount of B that has not precipitated as BN and the magnetic property after the finish annealing)

Further, a relationship between an amount of B that has not precipitated as BN and the magnetic property after the finish annealing was examined. A result of the examination is illustrated in FIG. 3. In FIG. 3, the horizontal axis indicates a B content (mass %), and the vertical axis indicates the value (mass %) obtained by converting the precipitation amount of BN into B. Further, white circles each indicate that the magnetic flux density B8 was 1.88 T or more, and black squares each indicate that the magnetic flux density B8 was less than 1.88 T. As illustrated in FIG. 3, in the samples each having the amount of B that has not precipitated as BN being a certain value or more, the magnetic flux density B8 was low. This indicates that the secondary recrystallization was unstable.

Further, as a result of examination of a form of the precipitates in the samples each having the good magnetic property, it turned out that MnS becomes a nucleus and BN precipitates compositely on MnS. Such composite precipitates are effective as inhibitors that stabilize the secondary recrystallization.

Figure 4:
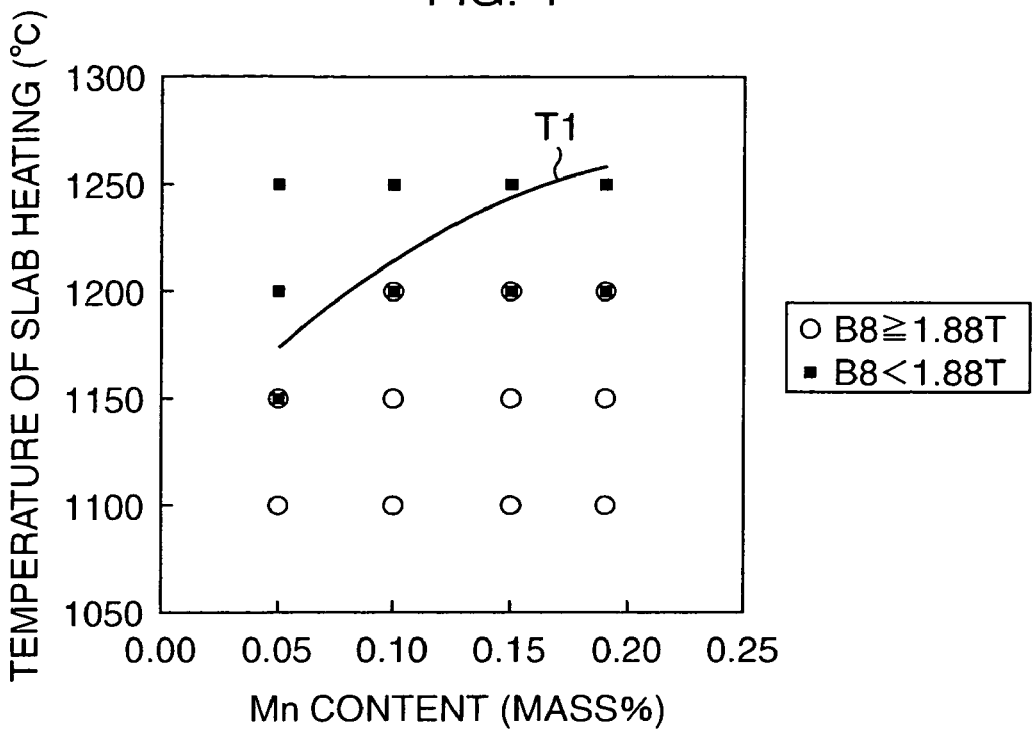
FIG. 4 is a view showing the result of the first experiment (a relationship between a condition of hot rolling and the magnetic property after the finish annealing)

Further, a relationship between a condition of the hot rolling and the magnetic property after the finish annealing was examined. A result of the examination is illustrated in FIG. 4. In FIG. 4, the horizontal axis indicates a Mn content (mass %) and the vertical axis indicates a temperature (° C.) of slab heating at the time of hot rolling. Further, white circles each indicate that the magnetic flux density B8 was 1.88 T or more, and black squares each indicate that the magnetic flux density B8 was less than 1.88 T. Further, a curve in FIG. 4 indicates a solution temperature T1 (° C.) of MnS expressed by equation (1) below. As illustrated in FIG. 4, it turned out that in the samples in which the slab heating is performed at a temperature determined according to the Mn content or lower, the high magnetic flux density B8 is obtained. Further, it also turned out that the temperature approximately agrees with the solution temperature T1 of MnS. That is, it turned out that it is effective to perform the slab heating in a temperature zone where MnS is not completely solid-dissolved.

$$T1=14855/(6.82-\log([Mn]\times[S]))-273 \quad (1)$$

Here, [Mn] represents the Mn content (mass %), [S] represents an S content (mass %).

Further, as a result of examination of precipitation behavior of MnS and BN, it turned out that, if MnS exists, BN compositely precipitated preferentially with MnS serving as a nucleus, and a precipitation temperature zone of BN is 800° C. to 1000° C.

Further, the present inventors examined conditions effective for the precipitation of BN. In the examination, first, various silicon steel slabs containing Si: 3.3 mass %, C: 0.06 mass %, acid-soluble Al: 0.027 mass %, N: 0.006 mass %, Mn: 0.1 mass %, S: 0.007 mass %, and B: 0.0014 mass %, and a balance being composed of Fe and inevitable impurities and having a thickness of 40 mm were obtained. Next, the silicon steel slabs were heated at a temperature of 1200° C. and were subjected to rough rolling at 1100° C. so as to have a thickness of 15 mm. Then, the resultant silicon steel slabs were held in a furnace at 1050° C. to 800° C. for a predetermined period of time. Thereafter, finish rolling was performed and thereby hot-rolled steel strips each having a thickness of 2.3 mm were obtained. Then, the hot-rolled steel strips were cooled with water down to a room temperature, and the precipitate was examined. As a result, it turned out that, if the silicon steel slab is held in a temperature range between 1000° C. and 800° C. for 300 seconds or longer between the rough rolling and the finish rolling, an excellent composite precipitate is generated.

(Second Experiment)

In the second experiment, first, various silicon steel slabs containing Si: 3.3 mass %, C: 0.06 mass %, acid-soluble Al: 0.028 mass %, N: 0.007 mass %, Mn: 0.05 mass % to 0.20 mass %, Se: 0.007 mass %, and B: 0.0010 mass % to 0.0035 mass %, and a balance being composed of Fe and inevitable impurities were obtained. Next, the silicon steel slabs were heated at a temperature of 1100° C. to 1250° C. and were subjected to hot rolling. In the hot rolling, rough rolling was performed at 1050° C. and then finish rolling was performed at 1000° C., and thereby hot-rolled steel strips each having a thickness of 2.3 mm were obtained. Then, cooling water was jetted onto the hot-rolled steel strips to then let the hot-rolled steel strips cool down to 550° C., and thereafter the hot-rolled steel strips were cooled down in the atmosphere. Subsequently, annealing of the hot-rolled steel strips was performed. Next, cold rolling was performed, and thereby cold-rolled steel strips each having a thickness of 0.22 mm were obtained. Thereafter, the cold-rolled steel strips were heated at a rate of 15° C./s, and were subjected to decarburization annealing at a temperature of 840° C., and thereby decarburization-annealed steel strips were obtained. Subsequently, the decarburization-annealed steel strips were annealed in an ammonia containing atmosphere to increase nitrogen in the steel strips up to 0.022 mass %. Next, an annealing separating agent containing MgO as its main component was coated on the steel strips and finish annealing was performed. In this manner, various samples were manufactured.

Figure 5:
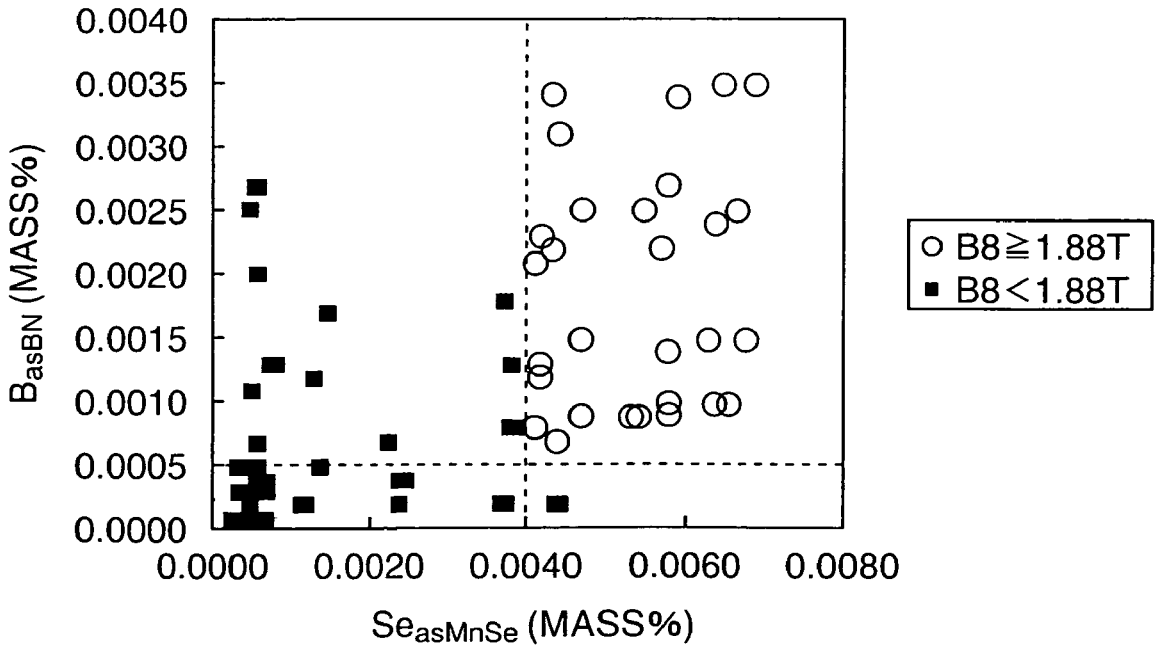
FIG. 5 is a view showing a result of a second experiment (a relationship between precipitates in a hot-rolled steel strip and a magnetic property after finish annealing)

Then, a relationship between precipitates in the hot-rolled steel strip and a magnetic property after the finish annealing was examined. A result of the examination is illustrated in FIG. 5. In FIG. 5, the horizontal axis indicates a value (mass %) obtained by converting a precipitation amount of MnSe into an amount of Se, and the vertical axis indicates a value (mass %) obtained by converting a precipitation amount of BN into B. The horizontal axis corresponds to an amount of Se that has precipitated as MnSe (mass %). Further, white circles each indicate that the magnetic flux density B8 was 1.88 T or more, and black squares each indicate that the magnetic flux density B8 was less than 1.88 T. As illustrated in FIG. 5, in the samples each having the precipitation amounts of MnSe and BN each being less than a certain value, the magnetic flux density B8 was low. This indicates that secondary recrystallization was unstable.

Figure 6:
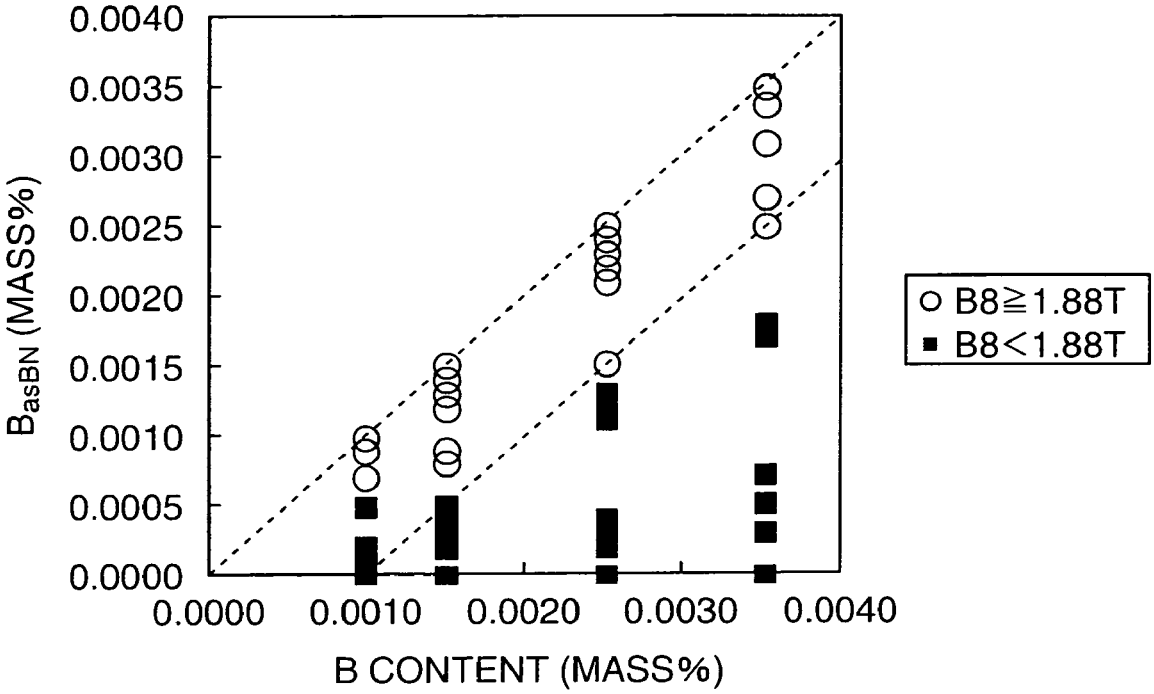
FIG. 6 is a view showing the result of the second experiment (a relationship between an amount of B that has not precipitated as BN and the magnetic property after the finish annealing)

Further, a relationship between an amount of B that has not precipitated as BN and the magnetic property after the finish annealing was examined. A result of the examination is illustrated in FIG. 6. In FIG. 6, the horizontal axis indicates a B content (mass %), and the vertical axis indicates the value (mass %) obtained by converting the precipitation amount of BN into B. Further, white circles each indicate that the magnetic flux density B8 was 1.88 T or more, and black squares each indicate that the magnetic flux density B8 was less than 1.88 T. As illustrated in FIG. 6, in the samples each having the amount of B that has not precipitated as BN being a certain value or more, the magnetic flux density B8 was low. This indicates that the secondary recrystallization was unstable.

Further, as a result of examination of a form of the precipitates in the samples each having the good magnetic property, it turned out that MnSe becomes a nucleus and BN precipitates compositely on MnSe. Such composite precipitates are effective as inhibitors that stabilize the secondary recrystallization.

Figure 7:
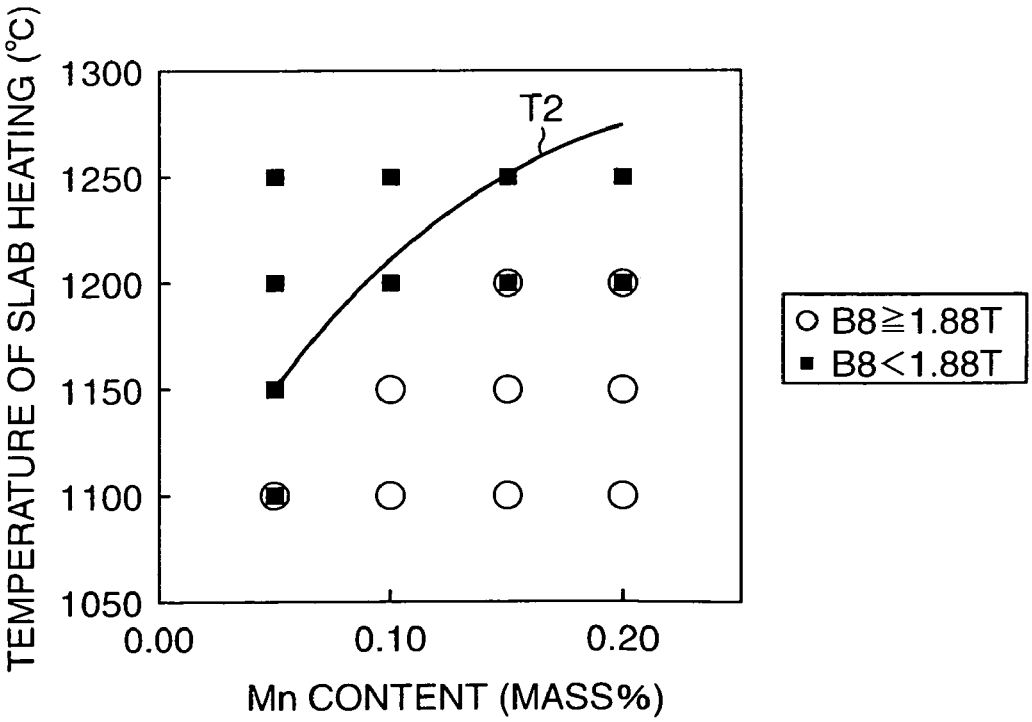
FIG. 7 is a view showing the result of the second experiment (a relationship between a condition of hot rolling and the magnetic property after the finish annealing)

Further, a relationship between a condition of the hot rolling and the magnetic property after the finish annealing was examined. A result of the examination is illustrated in FIG. 7. In FIG. 7, the horizontal axis indicates a Mn content (mass %) and the vertical axis indicates a temperature (° C.) of slab heating at the time of hot rolling. Further, white circles each indicate that the magnetic flux density B8 was 1.88 T or more, and black squares each indicate that the magnetic flux density B8 was less than 1.88 T. Further, a curve in FIG. 7 indicates a solution temperature T2 (° C.) of MnSe expressed by equation (2) below. As illustrated in FIG. 7, it turned out that in the samples in which the slab heating is performed at a temperature determined according to the Mn content or lower, the high magnetic flux density B8 is obtained. Further, it also turned out that the temperature approximately agrees with the solution temperature T2 of MnSe. That is, it turned out that it is effective to perform the slab heating in a temperature zone where MnSe is not completely solid-dissolved.

$$T2=10733/(4.08-\log([Mn]\times[Se]))-273 \quad (2)$$

Here, [Se] represents a Se content (mass %).

Further, as a result of examination of precipitation behavior of MnSe and BN, it turned out that, if MnSe exists, BN compositely precipitated preferentially with MnSe serving as a nucleus, and a precipitation temperature zone of BN is 800° C. to 1000° C.

Further, the present inventors examined conditions effective for the precipitation of BN. In the examination, first, various silicon steel slabs containing Si: 3.3 mass %, C: 0.06 mass %, acid-soluble Al: 0.028 mass %, N: 0.007 mass %, Mn: 0.1 mass %, Se: 0.007 mass %, and B: 0.0014 mass %, and a balance being composed of Fe and inevitable impurities and having a thickness of 40 mm were obtained. Next, the silicon steel slabs were heated at a temperature of 1200° C. and were subjected to rough rolling at 1100° C. so as to have a thickness of 15 mm. Then, the resultant silicon steel slabs were held in a furnace at 1050° C. to 800° C. for a predetermined period of time. Thereafter, finish rolling was performed and thereby hot-rolled steel strips each having a thickness of 2.3 mm were obtained. Then, the hot-rolled steel strips were cooled with water down to a room temperature, and the precipitate was examined. As a result, it turned out that, if the silicon steel slab is held in a temperature range between 1000° C. and 800° C. for 300 seconds or longer between the rough rolling and the finish rolling, an excellent composite precipitate is generated.

(Third Experiment)

In the third experiment, first, various silicon steel slabs containing Si: 3.3 mass %, C: 0.06 mass %, acid-soluble Al: 0.026 mass %, N: 0.009 mass %, Mn: 0.05 mass % to 0.20 mass %, S: 0.005 mass %, Se: 0.007 mass %, and B: 0.0010 mass % to 0.0035 mass %, and a balance being composed of Fe and inevitable impurities were obtained. Next, the silicon steel slabs were heated at a temperature of 1100° C. to 1250° C. and were subjected to hot rolling. In the hot rolling, rough rolling was performed at 1050° C. and then finish rolling was performed at 1000° C., and thereby hot-rolled steel strips each having a thickness of 2.3 mm were obtained. Then, cooling water was jetted onto the hot-rolled steel strips to then let the hot-rolled steel strips cool down to 550° C., and thereafter the hot-rolled steel strips were cooled down in the atmosphere. Subsequently, annealing of the hot-rolled steel strips was performed. Next, cold rolling was performed, and thereby cold-rolled steel strips each having a thickness of 0.22 mm were obtained. Thereafter, the cold-rolled steel strips were heated at a rate of 15° C./s, and were subjected to decarburization annealing at a temperature of 840° C., and thereby decarburization-annealed steel strips were obtained. Subsequently, the decarburization-annealed steel strips were annealed in an ammonia containing atmosphere to increase nitrogen in the steel strips up to 0.022 mass %. Next, an annealing separating agent containing MgO as its main component was coated on the steel strips and finish annealing was performed. In this manner, various samples were manufactured.

Figure 8:
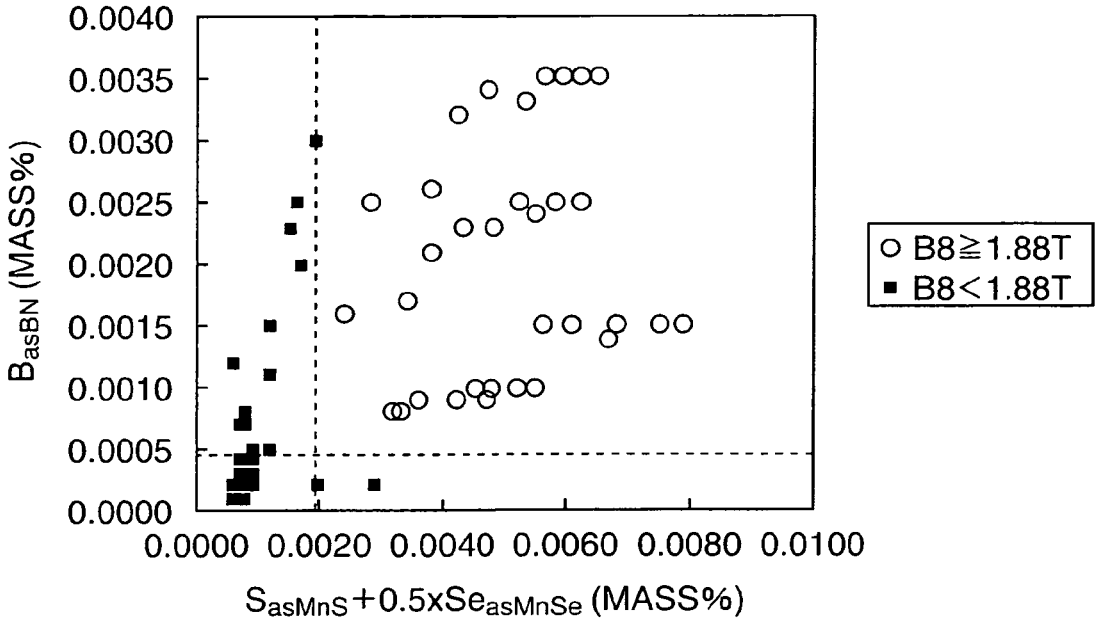
FIG. 8 is a view showing a result of a third experiment (a relationship between precipitates in a hot-rolled steel strip and a magnetic property after finish annealing)

Then, a relationship between precipitates in the hot-rolled steel strip and a magnetic property after the finish annealing was examined. A result of the examination is illustrated in FIG. 8. In FIG. 8, the horizontal axis indicates the sum (mass %) of a value obtained by converting a precipitation amount of MnS into an amount of S and a value obtained by multiplying a value obtained by converting a precipitation amount of MnSe into an amount of Se by 0.5, and the vertical axis indicates a value (mass %) obtained by converting a precipitation amount of BN into B. Further, white circles each indicate that the magnetic flux density B8 was 1.88 T or more, and black squares each indicate that the magnetic flux density B8 was less than 1.88 T. As illustrated in FIG. 8, in the samples each having the precipitation amounts of MnS, MnSe, and BN each being less than a certain value, the magnetic flux density B8 was low. This indicates that secondary recrystallization was unstable.

Figure 9:
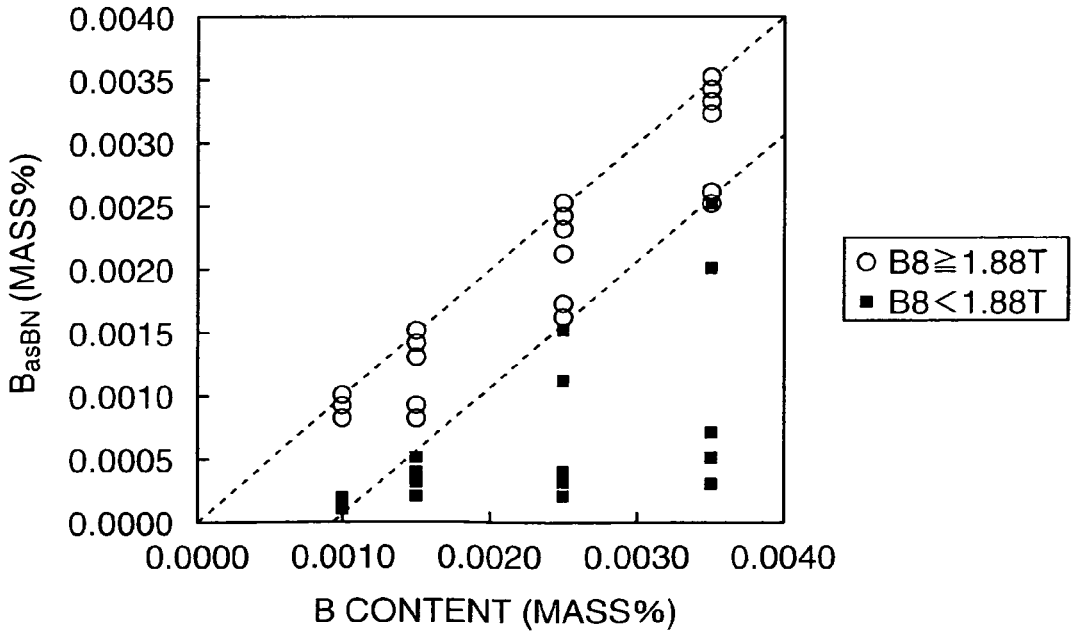
FIG. 9 is a view showing the result of the third experiment (a relationship between an amount of B that has not precipitated as BN and the magnetic property after the finish annealing)

Further, a relationship between an amount of B that has not precipitated as BN and the magnetic property after the finish annealing was examined. A result of the examination is illustrated in FIG. 9. In FIG. 9, the horizontal axis indicates a B content (mass %), and the vertical axis indicates the value (mass %) obtained by converting the precipitation amount of BN into B. Further, white circles each indicate that the magnetic flux density B8 was 1.88 T or more, and black squares each indicate that the magnetic flux density B8 was less than 1.88 T. As illustrated in FIG. 9, in the samples each having the amount of B that has not precipitated as BN being a certain value or more, the magnetic flux density B8 was low. This indicates that the secondary recrystallization was unstable.

Further, as a result of examination of a form of the precipitates in the samples each having the good magnetic property, it turned out that MnS or MnSe becomes a nucleus and BN precipitates compositely on MnS or MnSe. Such composite precipitates are effective as inhibitors that stabilize the secondary recrystallization.

Figure 10:
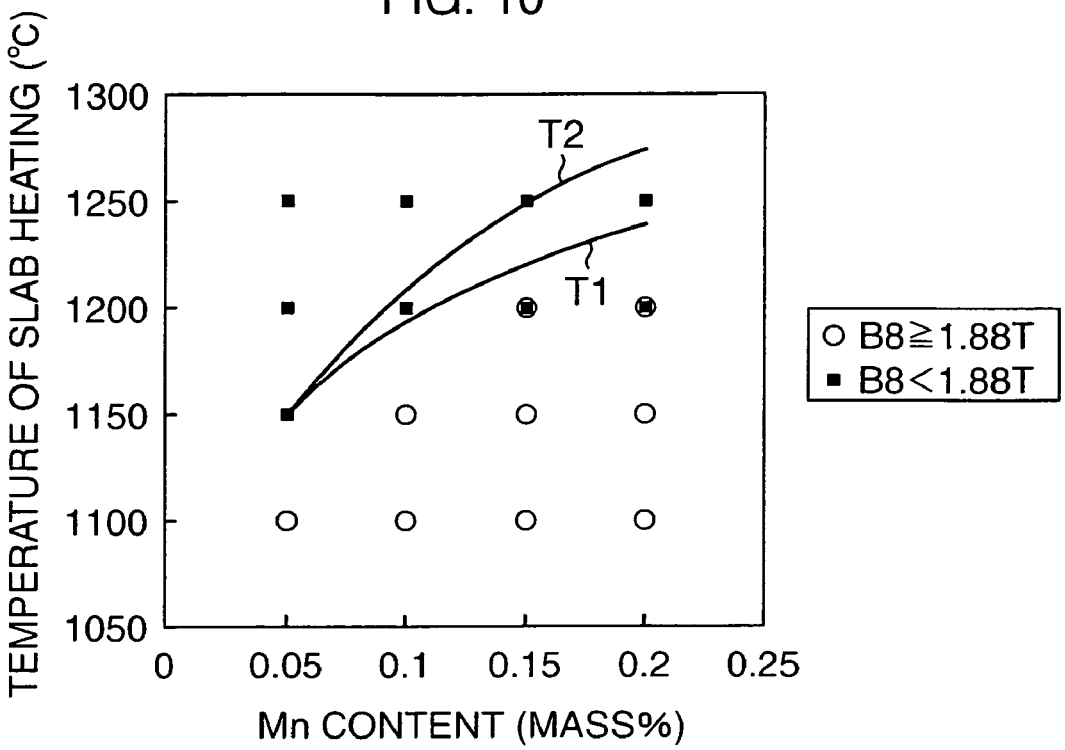
FIG. 10 is a view showing the result of the third experiment (a relationship between a condition of hot rolling and the magnetic property after the finish annealing)

Further, a relationship between a condition of the hot rolling and the magnetic property after the finish annealing was examined. A result of the examination is illustrated in FIG. 10. In FIG. 10, the horizontal axis indicates a Mn content (mass %) and the vertical axis indicates a temperature (° C.) of slab heating at the time of hot rolling. In FIG. 10, the horizontal axis indicates the B content (mass %) and the vertical axis indicates the temperature (° C.) of the slab heating at the time of hot rolling. Further, white circles each indicate that the magnetic flux density B8 was 1.88 T or more, and black squares each indicate that the magnetic flux density B8 was less than 1.88 T. Further, two curves in FIG. 10 indicate the solution temperature T1 (° C.) of MnS expressed by equation (1) and the solution temperature T2 (° C.) of MnSe expressed by equation (2). As illustrated in FIG. 10, it turned out that in the samples in which the slab heating is performed at a temperature determined according to the Mn content or lower, the high magnetic flux density B8 is obtained. Further, it also turned out that the temperature approximately agrees with the solution temperature T1 of MnS and the solution temperature T2 of MnSe. That is, it turned out that it is effective to perform the slab heating in a temperature zone where MnS and MnSe, are not completely solid-dissolved.

Further, as a result of examination of precipitation behavior of MnS, MnSe and BN, it turned out that, if MnS and MnSe exist, BN compositely precipitated preferentially with MnS and MnSe serving as a nucleus, and a precipitation temperature zone of BN is 800° C. to 1000° C.

Further, the present inventors examined conditions effective for the precipitation of BN. In the examination, first, various silicon steel slabs containing Si: 3.3 mass %, C: 0.06 mass %, acid-soluble Al: 0.027 mass %, N: 0.007 mass %, Mn: 0.1 mass %, S: 0.006 mass %, Se: 0.008 mass %, and B: 0.0017 mass %, and a balance being composed of Fe and inevitable impurities and having a thickness of 40 mm were obtained. Next, the silicon steel slabs were heated at a temperature of 1200° C. and were subjected to rough rolling at 1100° C. so as to have a thickness of 15 mm. Then, the resultant silicon steel slabs were held in a furnace at 1050° C. to 800° C. for a predetermined period of time. Thereafter, finish rolling was performed and thereby hot-rolled steel strips each having a thickness of 2.3 mm were obtained. Then, the hot-rolled steel strips were cooled with water down to a room temperature, and the precipitate was examined. As a result, it turned out that, if the silicon steel slab is held in a temperature range between 1000° C. and 800° C. for 300 seconds or longer between the rough rolling and the finish rolling, an excellent composite precipitate is generated.

According to these results of the first to third experiments, it is found that controlling the precipitated form of BN makes it possible to stably improve the magnetic property of the grain-oriented electrical steel sheet. The reason why the secondary recrystallization becomes unstable, thereby making it impossible to obtain the good magnetic property in the case when B does not precipitate compositely on MnS or MnSe as BN has not been clarified yet so for, but is considered as follows.

Generally, B in a solid solution state is likely to segregate in grain boundaries, and BN that has precipitated independently after the hot rolling is often fine. B in a solid solution state and fine BN suppress grain growth at the time of primary recrystallization as strong inhibitors in a low-temperature zone where the decarburization annealing is performed, and in a high-temperature zone where the finish annealing is performed, B in a solid solution state and fine BN do not function as inhibitors locally, thereby turning the grain structure into a mixed grain structure. Thus, in the low-temperature zone, primary recrystallized grains are small, so that the magnetic flux density of the grain-oriented electrical steel sheet is reduced. Further, in the high-temperature zone, the grain structure is turned into the mixed grain structure, so that the secondary recrystallization becomes unstable.

Next, an embodiment of the present invention made on the knowledge will be explained.

First, limitation reasons of the components of the silicon steel material will be explained.

The silicon steel material used in this embodiment contains Si: 0.8 mass % to 7 mass %, acid-soluble Al: 0.01 mass % to 0.065 mass %, N: 0.004 mass % to 0.012 mass %, Mn: 0.05 mass % to 1 mass %, S and Se: 0.003 mass % to 0.015 mass % in total amount, and B: 0.0005 mass % to 0.0080 mass %, and a C content being 0.085 mass % or less, and a balance being composed of Fe and inevitable impurities.

Si increases electrical resistance to reduce a core loss. However, when a Si content exceeds 7 mass %, the cold rolling becomes difficult to be performed, and a crack is likely to be caused at the time of cold rolling. Thus, the Si content is set to 7 mass % or less, and is preferably 4.5 mass % or less, and is more preferably 4 mass % or less. Further, when the Si content is less than 0.8 mass %, a y transformation is caused at the time of finish annealing to thereby make a crystal orientation of the grain-oriented electrical steel sheet deteriorate. Thus, the Si content is set to 0.8 mass % or more, and is preferably 2 mass % or more, and is more preferably 2.5 mass % or more.

C is an element effective for controlling the primary recrystallization structure, but adversely affects the magnetic property. Thus, in this embodiment, before the finish annealing (step S5), the decarburization annealing is performed (step S4). However, when the C content exceeds 0.085 mass %, a time taken for the decarburization annealing becomes long, and productivity in industrial production is impaired. Thus, the C content is set to 0.85 mass % or less, and is preferably 0.07 mass % or less.

Acid-soluble Al bonds to N to precipitate as (Al, Si) N and functions as an inhibitor. In the case when a content of acid-soluble Al falls within a range of 0.01 mass % to 0.065 mass %, the secondary recrystallization is stabilized. Thus, the content of acid-soluble Al is set to be not less than 0.01 mass % nor more than 0.065 mass %. Further, the content of acid-soluble Al is preferably 0.02 mass % or more, and is more preferably 0.025 mass % or more. Further, the content of acid-soluble Al is preferably 0.04 mass % or less, and is more preferably 0.03 mass % or less.

B bonds to N to precipitate compositely on MnS or MnSe as BN and functions as an inhibitor. In the case when a B content falls within a range of 0.0005 mass % to 0.0080 mass %, the secondary recrystallization is stabilized. Thus, the B content is set to be not less than 0.0005 mass % nor more than 0.0080 mass %. Further, the B content is preferably 0.001 mass % or more, and is more preferably 0.0015 mass % or more. Further, the B content is preferably 0.0040 mass % or less, and is more preferably 0.0030 mass % or less.

N bonds to B or Al to function as an inhibitor. When an N content is less than 0.004 mass %, it is not possible to obtain a sufficient amount of the inhibitor. Thus, the N content is set to 0.004 mass % or more, and is preferably 0.006 mass % or more, and is more preferably 0.007 mass % or more. On the other hand, when the N content exceeds 0.012 mass %, a hole called a blister occurs in the steel strip at the time of cold rolling. Thus, the N content is set to 0.012 mass % or less, and is preferably 0.010 mass % or less, and is more preferably 0.009 mass % or less.

Mn, S and Se produce MnS and MnSe to be a nucleus on which BN precipitates compositely, and composite precipitates function as an inhibitor. In the case when a Mn content falls within a range of 0.05 mass % to 1 mass %, the secondary recrystallization is stabilized. Thus, the Mn content is set to be not less than 0.05 mass % nor more than 1 mass %. Further, the Mn content is preferably 0.08 mass % or more, and is more preferably 0.09 mass % or more. Further, the Mn content is preferably 0.50 mass % or less, and is more preferably 0.2 mass % or less.

Further, in the case when a content of S and Se falls within a range of 0.003 mass % to 0.015 mass % in total amount, the secondary recrystallization is stabilized. Thus, the content of S and Se is set to be not less than 0.003 mass % nor more than 0.015 mass % in total amount. Further, in terms of preventing occurrence of a crack in the hot rolling, inequation (5) below is preferably satisfied. Incidentally, only either S or Se may be contained in the silicon steel material, or both S and Se may also be contained in the silicon steel material. In the case when both S and Se are contained, it is possible to promote the precipitation of BN more stably and to improve the magnetic property stably.

$$[Mn]/([S]+[Se])\cong 4 \quad (5)$$

Ti forms coarse TiN to affect the precipitation amounts of BN and (Al, Si)N functioning as an inhibitor. When a Ti content exceeds 0.004 mass %, the good magnetic property is not easily obtained. Thus, the Ti content is preferably 0.004 mass % or less.

Further, one or more element(s) selected from a group consisting of Cr, Cu, Ni, P, Mo, Sn, Sb, and Bi may also be contained in the silicon steel material in ranges below.

Cr improves an oxide layer formed at the time of decarburization annealing, and is effective for forming the glass film made by reaction of the oxide layer and MgO being the main component of the annealing separating agent at the time of finish annealing. However, when a Cr content exceeds 0.3 mass %, decarburization is noticeably prevented. Thus, the Cr content may be set to 0.3 mass % or less.

Cu increases specific resistance to reduce a core loss. However, when a Cu content exceeds 0.4 mass %, the effect is saturated. Further, a surface flaw called "copper scab" is sometimes caused at the time of hot rolling. Thus, the Cu content may be set to 0.4 mass % or less.

Ni increases specific resistance to reduce a core loss. Further, Ni controls a metallic structure of the hot-rolled steel strip to improve the magnetic property. However, when a Ni content exceeds 1 mass %, the secondary recrystallization becomes unstable. Thus, the Ni content may be set to 1 mass % or less.

P increases specific resistance to reduce a core loss. However, when a P content exceeds 0.5 mass %, a fracture occurs easily at the time of cold rolling due to embrittlement. Thus, the P content may be set to 0.5 mass % or less.

Mo improves a surface property at the time of hot rolling. However, when a Mo content exceeds 0.1 mass %, the effect is saturated. Thus, the Mo content may be set to 0.1 mass % or less.

Sn and Sb are grain boundary segregation elements. The silicon steel material used in this embodiment contains Al, so that there is sometimes a case that Al is oxidized by moisture released from the annealing separating agent depending on the condition of the finish annealing. In this case, variations in inhibitor strength occur depending on the position in the grain-oriented electrical steel sheet, and the magnetic property also sometimes varies. However, in the case when the grain boundary segregation elements are contained, the oxidation of Al can be suppressed. That is, Sn and Sb suppress the oxidation of Al to suppress the variations in the magnetic property. However, when a content of Sn and Sb exceeds 0.30 mass % in total amount, the oxide layer is not easily formed at the time of decarburization annealing, and thereby the formation of the glass film made by the reaction of the oxide layer and MgO being the main component of the annealing separating agent at the time of finish annealing becomes insufficient. Further, the decarburization is noticeably prevented. Thus, the content of Sn and Sb may be set to 0.3 mass % or less in total amount.

Bi stabilizes precipitates such as sulfides to strengthen the function as an inhibitor. However, when a Bi content exceeds 0.0.1 mass %, the formation of the glass film is adversely affected. Thus, the Bi content may be set to 0.01 mass % or less.

Next, each treatment in this embodiment will be explained.

The silicon steel material (slab) having the above-described components may be manufactured in a manner that, for example, steel is melted in a converter, an electric furnace, or the like, and the molten steel is subjected to a vacuum degassing treatment according to need, and next is subjected to continuous casting. Further, the silicon steel material may also be manufactured in a manner that in place of the continuous casting, an ingot is made to then be bloomed. The thickness of the silicon steel slab is set to, for example, 150 mm to 350 mm, and is preferably set to 220 mm to 280 mm. Further, what is called a thin slab having a thickness of 30 mm to 70 mm may also be manufactured. In the case when the thin slab is manufactured, the rough rolling performed when obtaining the hot-rolled steel strip may be omitted.

After the silicon steel slab is manufactured, the slab heating is performed, and the hot rolling (step S1) is performed. Then, in this embodiment, the conditions of the slab heating and the hot rolling are set such that BN is made to precipitate compositely on MnS and/or MnSe, and that the precipitation amounts of BN, MnS, and MnSe in the hot-rolled steel strip satisfy inequations (6) to (8) below.

$$B_{asBN} \square 0.0005 \quad (6)$$

$$[B]-B_{asBN} \square 0.001 \quad (7)$$

$$S_{asMnS}+0.5\times Se_{asMnSe} \square 0.002 \quad (8)$$

Here, "$B_{asBN}$" represents the amount of B that has precipitated as BN (mass %), "$S_{asMnS}$" represents the amount of S that has precipitated as MnS (mass %), and "$Se_{asMnSe}$" represents the amount of Se that has precipitated as MnSe (mass %).

As for B, a precipitation amount and a solid solution amount of B are controlled such that inequation (6) and inequation (7) are satisfied. A certain amount or more of BN is made to precipitate in order to secure an amount of the inhibitors. Further, in the case when the amount of solid-dissolved B is large, there is sometimes a case that unstable fine precipitates are formed in the subsequent processes to adversely affect the primary recrystallization structure.

MnS and MnSe each function as a nucleus on which BN precipitates compositely. Thus, in order to make BN precipitate sufficiently to thereby improve the magnetic property, the precipitation amounts of MnS and MnSe are controlled such that inequation (8) is satisfied.

The condition expressed in inequation (7) is derived from FIG. 3, FIG. 6, and FIG. 9. It is found from FIG. 3, FIG. 6, and FIG. 9 that in the case of $[B]-B_{asBN}$ being 0.001 mass % or less, the good magnetic flux density, being the magnetic flux density B8 of 1.88 T or more, is obtained.

The conditions expressed in inequation (6) and inequation (8) are derived from FIG. 2, FIG. 5, and FIG. 8. It is found that in the case when $B_{asBN}$ is 0.0005 mass % or more and $S_{asMnS}$ is 0.002 mass % or more, the good magnetic flux density, being the magnetic flux density B8 of 1.88 T or more, is obtained from FIG. 2. Similarly, it is found that in the case when $B_{asBN}$ is 0.0005 mass % or more and $Se_{asMnSe}$ is 0.004 mass % or more, the good magnetic flux density, being the magnetic flux density B8 of 1.88 T or more, is obtained from FIG. 5. Similarly, it is found that in the case when $B_{asBN}$ is 0.0005 mass % or more and $S_{asMnS}+0.5\times Se_{asMnSe}$ is 0.002 mass % or more, the good magnetic flux density, being the magnetic flux density B8 of 1.88 T or more, is obtained from FIG. 8. Then, as long as $S_{asMnS}$ is 0.002 mass % or more, $S_{asMnS}+0.5\times Se_{asMnSe}$ becomes 0.002 mass % or more inevitably, and as long as $Se_{asMnSe}$ is 0.004 mass % or more, $S_{asMnS}+0.5\times Se_{asMnSe}$ becomes 0.002 mass % or more inevitably. Thus, it is important that $S_{asMnS}+0.5\times Se_{asMnSe}$ is 0.002 mass % or more.

Figure 11:
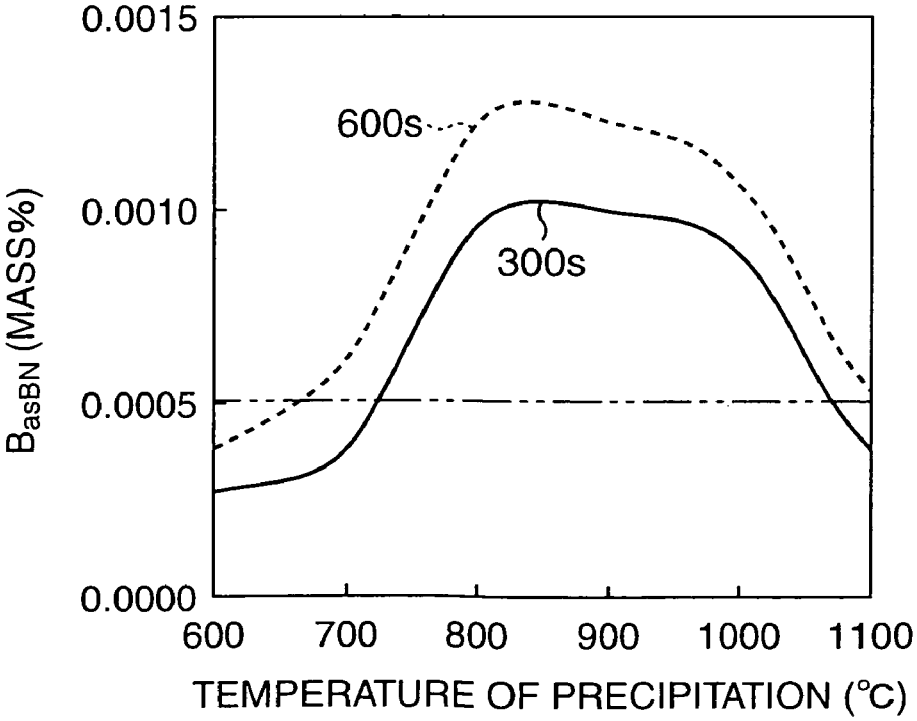
FIG. 11 is a view showing a relationship between a precipitation amount of BN, a holding temperature and a holding time.

In addition, in the hot rolling, in order to precipitate a sufficient amount of BN, it is necessary to hold the silicon steel material (slab) in a temperature range between 1000° C. and 800° C. for 300 seconds or longer during the hot rolling as illustrated in FIG. 11. If the holding temperature is lower than 800° C., the diffusion speeds of B and N are small, and the period of time required for the precipitation of BN is longer. Meanwhile, if the holding temperature exceeds 1000° C., BN becomes more soluble, the precipitation amount of BN is not sufficient, and a high magnetic flux density may not be obtained. In addition, if the holding time is less than 300 seconds, the diffusion distances of B and N are short, and the precipitation amount of BN is insufficient.

The method of holding the silicon steel material (slab) in the temperature range between 1000° C. and 800° C. is not particularly limited. For example, the following method is effective. First, rough rolling is performed, and a steel strip is wound into a coil form. Then, the steel strip is held or slowly cooled in an equipment such as a coil box. After that, finish rolling is performed in the temperature range between 1000° C. and 800° C. while the steel strip is wound off.

The method of precipitating MnS and/or MnSe is not particularly limited. For example, it is preferable that the temperature of the slab heating is set so as to satisfy the following conditions.

(i) in the case of S and Se being contained in the silicon steel slab the temperature T1 (° C.) expressed by equation (1) or lower, and the temperature T2 (° C.) expressed by equation (2) or lower (ii) in the case of no Se being contained in the silicon steel slab the temperature T1 (° C.) expressed by equation (1) or lower (iii) in the case of no S being contained in the silicon steel slab the temperature T2 (° C.) expressed by equation (2) or lower $$T1=14855/(6.82-\log([Mn]\times[S]))-273 \quad (1)$$

$$T2=10733/(4.08-\log([Mn]\times[Se]))-273 \quad (2)$$

This is because when the slab heating is performed at such temperatures, MnS and MnSe are not completely solid-dissolved at the time of slab heating, and the precipitations of MnS and MnSe are promoted during the hot rolling. As is clear from FIG. 4, FIG. 7, and FIG. 10, the solution temperatures T1 and T2 approximately agree with the upper limit of the slab heating temperature capable of obtaining the magnetic flux density B8 of 1.88 or more.

In addition, it is further preferable that the temperature of the slab heating is set so as to also satisfy the following conditions. This serves to precipitate a preferable amount of MnS or MnSe during the slab heating.

(i) in the case of no Se being contained in the silicon steel slab the temperature T3 (° C.) expressed by equation (9) or lower (ii) in the case of no S being contained in the silicon steel slab the temperature T4 (° C.) expressed by equation (10) or lower $$T3=14855/(6.82-\log(([Mn]-0.0034)\times([S]-0.002)))-273 \quad (9)$$

$$T4=10733/(4.08-\log(([Mn]-0.0028)\times([Se]-0.004)))-273 \quad (10)$$

In the case when the temperature of the slab heating is too high, MnS and/or MnSe are sometimes solid-dissolved completely. In this case, it becomes difficult to make MnS and/or MnSe precipitate at the time of hot rolling. Thus, the slab heating is preferably performed at the temperature T1 and/or the temperature T2 or lower. Further, if the temperature of the slab heating is the temperature T3 or T4 or lower, a preferable amount of MnS or MnSe precipitates during the slab heating, and thus it becomes possible to make BN precipitate compositely on MnS or MnSe to form effective inhibitors easily.

After the hot rolling (step S1), the annealing of the hot-rolled steel strip is performed (step S2). Next, the cold rolling is performed (step S3). As described above, the cold rolling may be performed only one time, or may also be performed a plurality of times with the intermediate annealing being performed therebetween. In the cold rolling, the final cold rolling rate is preferably set to 80% or more. This is to develop a good primary recrystallization aggregate structure.

Thereafter, the decarburization annealing is performed (step S4). As a result, C contained in the steel strip is removed. The decarburization annealing is performed in a moist atmosphere, for example. Further, the decarburization annealing is preferably performed at a time such that, for example, a grain diameter obtained by the primary recrystallization becomes 15 μm or more in a temperature zone of 770° C. to 950° C. This is to obtain the good magnetic property. Subsequently, the coating of the annealing separating agent and the finish annealing are performed (step S5). As a result, the grains oriented in the {110} <001> orientation preferentially grow by the secondary recrystallization.

Further, the nitriding treatment is performed between start of the decarburization annealing and occurrence of the secondary recrystallization in the finish annealing (step S6). This is to form an inhibitor of (Al, Si)N. The nitriding treatment may be performed during the decarburization annealing (step S4), or may also be performed during the finish annealing (step S5). In the case when the nitriding treatment is performed during the decarburization annealing, the annealing may be performed in an atmosphere containing a gas having nitriding capability such as ammonia, for example. Further, the nitriding treatment may be performed during a heating zone or a soaking zone in a continuous annealing furnace, or the nitriding treatment may also be performed at a stage after the soaking zone. In the case when the nitriding treatment is performed during the finish annealing, a powder having nitriding capability such as MnN, for example, may be added to the annealing separating agent.

In order to perform the secondary recrystallization more stably, it is desirable to adjust the degree of nitriding in the nitriding treatment (step S6) and to adjust the compositions of (Al, Si)N in the steel strip after the nitriding treatment. For example, according to the Al content, the B content, and the content of Ti existing inevitably, the degree of nitriding is preferably controlled so as to satisfy inequation (3) below, and the degree of nitriding is more preferably controlled so as to satisfy inequation (4) below. Inequation (3) and inequation (4) indicate an amount of N that is preferable to fix B as BN effective as an inhibitor and an amount of N that is preferable to fix Al as AlN or (Al, Si)N effective as an inhibitor.

$$[N]\square 14/27[Al]+14/11[B]+14/47[Ti] \quad (3)$$

$$[N]\square ⅔[Al]+14/11[B]+14/47[Ti] \quad (4)$$

Here, [N] represents an N content (mass %) of a steel strip obtained after the nitriding treatment, [Al] represents an acid-soluble Al content (mass %) of the steel strip obtained after the nitriding treatment, [B] represents a B content (mass %) of the steel strip obtained after the nitriding treatment, and [Ti] represents a Ti content (mass %) of the steel strip obtained after the nitriding treatment.

The method of the finish annealing (step S5) is also not limited in particular. It should be noted that, in this embodiment, the inhibitors are strengthened by BN, so that a heating rate in a temperature range of 1000° C. to 1100° C. is preferably set to 15° C./h or less in a heating process of the finish annealing. Further, in place of controlling the heating rate, it is also effective to perform isothermal annealing in which the steel strip is maintained in the temperature range of 1000° C. to 1100° C. for 10 hours or longer.

According to this embodiment as above, it is possible to stably manufacture the grain-oriented electrical steel sheet excellent in the magnetic property.

EXAMPLE

Next, experiments conducted by the present inventers will be explained. The conditions and so on in the experiments are examples employed for confirming the practicability and the effects of the present invention, and the present invention is not limited to those examples.

(Fourth Experiment)

In the fourth experiment, the effect of the B content in the case of no Se being contained was confirmed.

In the fourth experiment, first, slabs containing Si: 3.3 mass %, C: 0.06 mass %, acid-soluble Al: 0.028 mass %; N: 0.008 mass %, Mn: 0.1 mass %, S: 0.006 mass %, and B having an amount listed in Table 1 (0 mass % to 0.0045 mass %), and a balance being composed of Fe and inevitable impurities were manufactured. Next, the slabs were heated at 1180° C., and were subjected to hot rolling. In the hot rolling, rough rolling was performed at 1100° C., annealing in which the slabs were held at 950° C. for 300 seconds was performed, and after that, finish rolling was performed at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.024 mass %. Next, an annealing separating agent containing MgO as its main component was coated on the steel strips, and the steel strips were heated up to 1200° C. at a rate of 15° C./h and were finish annealed. Then, a magnetic property (the magnetic flux density B8) after the finish annealing was measured. The magnetic property (magnetic flux density B8) was measured based on JIS C2556. A result of the measurement is listed in Table 1.

TABLE 1

| | No. | B CONTENT (MASS %) | SLAB HEATING HEATING TEMPERATURE (° C.) | T1 (° C.) | T3 (° C.) | HOT ROLLING HOLDING TEMPERATURE (° C.) | HOLDING TIME (SEC) | NITRIDING TREATMENT N CONTENT (MASS %) | RIGHT SIDE OF INEQUATION (3) | RIGHT SIDE OF INEQUATION (4) | PRECIPITATES $B_{asBN}$ (MASS %) | [B] − $B_{asBN}$ (MASS %) | $S_{asMnS}$ (MASS %) | MAGNETIC PROPERTY MAGNETIC FLUX DENSITY B8 (T) |
|---|---|---|---|---|---|---|---|---|---|---|---|---|---|---|
| COMPARATIVE EXAMPLE | 1A | 0 | 1180 | 1206 | 1179 | 950 | 300 | 0.024 | 0.015 | 0.019 | 0 | 0 | 0.005 | 1.904 |
| EXAMPLE | 1B | 0.0008 | 1180 | 1206 | 1179 | 950 | 300 | 0.024 | 0.016 | 0.020 | 0.0008 | 0 | 0.005 | 1.918 |
| | 1C | 0.0019 | 1180 | 1206 | 1179 | 950 | 300 | 0.024 | 0.017 | 0.021 | 0.0018 | 0 | 0.005 | 1.926 |
| | 1D | 0.0031 | 1180 | 1206 | 1179 | 950 | 300 | 0.024 | 0.019 | 0.023 | 0.0031 | 0 | 0.005 | 1.925 |
| | 1E | 0.0045 | 1180 | 1206 | 1179 | 950 | 300 | 0.024 | 0.020 | 0.024 | 0.0043 | 0.0002 | 0.005 | 1.923 |

As listed in Table 1, in Comparative Example No. 1A having no B contained in the slab, the magnetic flux density was low, but in Examples No. 1B to No. 1E each having an appropriate amount of B contained in the slab, the good magnetic flux density was obtained.

(Fifth Experiment)

In the fifth experiment, the effects of the Mn content and the slab heating temperature in the case of no Se being contained were confirmed.

In the fifth experiment, first, slabs containing Si: 3.3 mass %, C: 0.06 mass %, acid-soluble Al: 0.028 mass %, N: 0.007 mass %, S: 0.006 mass %, B: 0.0015 mass %, and Mn having an amount listed in Table 2 (0.05 mass % to 0.2 mass %), and a balance being composed of Fe and inevitable impurities were manufactured. Next, the slabs were heated at 1200° C., and were subjected to hot rolling. In the hot rolling, for some of the samples (Examples No. 2A1 to No. 2A4), rough rolling was performed at 1100° C., annealing in which the slabs were held at 1000° C. for 500 seconds was performed, and after that, finish rolling was performed. In this manner, hot-rolled steel strips each having a thickness of 2.3 mm were obtained. On the other hand, for the other samples (Examples No. 2B1 to No. 2B4), rough rolling was performed at 1100° C., and after that, finish rolling was performed at 1020° C. without performing an annealing. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.022 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 2.

TABLE 2

| | No. | Mn CONTENT (MASS %) | SLAB HEATING HEATING TEMPERATURE (° C.) | HOT ROLLING HOLDING TEMPERATURE (° C.) | HOLDING TIME (SEC) | NITRIDING TREATMENT N CONTENT (MASS %) | PRECIPITATES $B_{asBN}$ (MASS %) | [B] − $B_{asBN}$ (MASS %) | $S_{asMnS}$ (MASS %) | MAGNETIC PROPERTY MAGNETIC FLUX DENSITY B8 (T) |
|---|---|---|---|---|---|---|---|---|---|---|
| EXAMPLE | 2A1 | 0.05 | 1200 | 1000 | 500 | 0.022 | 0.0008 | 0.0007 | 0.0022 | 1.890 |
| | 2A2 | 0.10 | 1200 | 1000 | 500 | 0.022 | 0.0010 | 0.0006 | 0.0025 | 1.925 |
| | 2A3 | 0.14 | 1200 | 1000 | 500 | 0.022 | 0.0012 | 0.0007 | 0.0038 | 1.929 |
| | 2A4 | 0.20 | 1200 | 1000 | 500 | 0.022 | 0.0013 | 0.0007 | 0.0053 | 1.924 |
| COMPARATIVE EXAMPLE | 2B1 | 0.05 | 1200 | — | — | 0.022 | 0.0003 | 0.0012 | 0.0060 | 1.683 |
| | 2B2 | 0.10 | 1200 | — | — | 0.022 | 0.0004 | 0.0011 | 0.0018 | 1.743 |
| | 2B3 | 0.14 | 1200 | — | — | 0.022 | 0.0004 | 0.0011 | 0.0034 | 1.750 |
| | 2B4 | 0.20 | 1200 | — | — | 0.022 | 0.0004 | 0.0011 | 0.0045 | 1.773 |

As listed in Table 2, the good magnetic flux density was obtained in Examples No. 2A1 to No. 2A4 in each of which the slab was held at a predetermined temperature at an intermediate stage of the hot rolling, but the magnetic flux density was low in Comparative Examples No. 2B1 to No. 2B4 in each of which such holding was not performed.

(Sixth Experiment)

In the sixth experiment, influences of the holding temperature and the holding time in the hot rolling in the case of no Se being contained were confirmed.

In the sixth experiment, first, slabs containing Si: 3.3 mass %, C: 0.06 mass %, acid-soluble Al: 0.028 mass %, N: 0.006 mass %, Mn: 0.12 mass %, S: 0.006 mass %, and B: 0.0015 mass %, and a balance being composed of Fe and inevitable impurities were manufactured. Next, the slabs were heated at 1200° C., then, annealing in which the slabs were held at 1050° C. to 700° C. for 100 seconds to 500 seconds was performed, and finish rolling was performed. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.021 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 3.

TABLE 3

| | | SLAB HEATING | | | HOT ROLLING | | | PRECIPITATES | | | MAGNETIC PROPERTY |
|---|---|---|---|---|---|---|---|---|---|---|---|
| | No. | HEATING TEMPERATURE (° C.) | T1 (° C.) | T3 (° C.) | HOLDING TEMPERATURE (° C.) | HOLDING TIME (SEC) | NITRIDING TREATMENT N CONTENT (MASS %) | $B_{asBN}$ (MASS %) | [B] − $B_{asBN}$ (MASS %) | $S_{asMnS}$ (MASS %) | MAGNETIC FLUX DENSITY B8 (T) |
| COMPARATIVE EXAMPLE | 3A | 1200 | 1206 | 1190 | 1050 | 500 | 0.021 | 0.0003 | 0.0012 | 0.0024 | 1.756 |
| EXAMPLE | 3B | 1200 | 1206 | 1190 | 1000 | 500 | 0.021 | 0.0008 | 0.0007 | 0.0026 | 1.920 |
| | 3C | 1200 | 1206 | 1190 | 900 | 500 | 0.021 | 0.0012 | 0.0003 | 0.0022 | 1.927 |
| | 3D | 1200 | 1206 | 1190 | 800 | 500 | 0.021 | 0.0011 | 0.0004 | 0.0021 | 1.925 |
| COMPARATIVE EXAMPLE | 3E | 1200 | 1206 | 1190 | 700 | 500 | 0.021 | 0.0004 | 0.0011 | 0.0017 | 1.742 |
| | 3F | 1200 | 1206 | 1190 | 900 | 100 | 0.021 | 0.0004 | 0.0011 | 0.0021 | 1.795 |
| | 3G | 1200 | 1206 | 1190 | 800 | 100 | 0.021 | 0.0003 | 0.0012 | 0.0018 | 1.753 |

As listed in Table 3, the good magnetic flux density was obtained in Examples No. 3B to No. 3D in each of which the slab was held at a predetermined temperature for a predetermined period of time at an intermediate stage of the hot rolling. But, the magnetic flux density was low in Comparative Examples No. 3A and No. 3E to No. 3G in each of which the holding temperature or the holding time was outside of the range of the present invention.

(Seventh Experiment)

In the eighth experiment, the effect of the N content after the nitriding treatment in the case of no Se being contained was confirmed.

In the seventh experiment, first, slabs containing Si: 3.3 mass %, C: 0.06 mass %, acid-soluble Al: 0.028 mass %, N: 0.006 mass %, Mn: 0.15 mass %, S: 0.006 mass %, and B: 0.002 mass %, a content of Ti that is an impurity being 0.0014 mass %, and a balance being composed of Fe and inevitable impurities were manufactured. Next, the slabs were heated at 1200° C., then annealing in which the slabs were held at 950° C. for 300 seconds was performed, and after that, finish rolling was performed. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.012 mass % to 0.022 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 4.

TABLE 4

| | | SLAB HEATING | | | HOT ROLLING | | NITRIDING TREATMENT | | |
|---|---|---|---|---|---|---|---|---|---|
| | No. | HEATING TEMPERATURE (° C.) | T1 (° C.) | T3 (° C.) | HOLDING TEMPERATURE (° C.) | HOLDING TIME (SEC) | N CONTENT (MASS %) | RIGHT SIDE OF INEQUATION (3) | RIGHT SIDE OF INEQUATION (4) |
| EXAMPLE | 4A | 1200 | 1233 | 1205 | 950 | 300 | 0.012 | 0.018 | 0.022 |
| | 4B | 1200 | 1233 | 1205 | 950 | 300 | 0.018 | 0.018 | 0.022 |
| | 4C | 1200 | 1233 | 1205 | 950 | 300 | 0.022 | 0.018 | 0.022 |

| | | PRECIPITATES | | | MAGNETIC PROPERTY MAGNETIC FLUX |
|---|---|---|---|---|---|
| | No. | $B_{asBN}$ (MASS %) | [B] − $B_{asBN}$ (MASS %) | $S_{asMnS}$ (MASS %) | DENSITY B8 (T) |
| EXAMPLE | 4A | 0.0017 | 0.0003 | 0.0034 | 1.882 |
| | 4B | 0.0017 | 0.0003 | 0.0034 | 1.914 |
| | 4C | 0.0017 | 0.0003 | 0.0034 | 1.920 |

As listed in Table 4, in Example No. 4C in which an N content after the nitriding treatment satisfied the relation of inequation (3) and the relation of inequation (4), the particularly good magnetic flux density was obtained. On the other hand, in Example No. 4B in which an N content after the nitriding treatment satisfied the relation of inequation (3) but did not satisfy the relation of inequation (4), the magnetic flux density was slightly lower than those in Example No. 4C. Further, in Example No. 4A in which an N content after the nitriding treatment did not satisfy the relation of inequation (3) and the relation of inequation (4), the magnetic flux density was slightly lower than those in Example No. 4B.

(Eighth Experiment)

In the eighth experiment, the effect of the components of the slab in the case of no Se being contained was confirmed.

In the eighth experiment, first, slabs containing components listed in Table 5 and a balance being composed of Fe and inevitable impurities were manufactured. Next, the slabs were heated at 1200° C., then annealing in which the slabs were held at 950° C. for 300 seconds was performed, and after that, finish rolling was performed. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 860° C. for 100 seconds, and thereby decarburization-annealed steel strips were obtained. Subsequently, the decarburization-annealed steel strips were annealed in an ammonia containing atmosphere to increase nitrogen in the steel strips up to 0.023 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 5.

As listed in Table 5, in Examples No. 5A to No. 5O each using the slab having the appropriate composition, the good magnetic flux density was obtained, but in Comparative Example No. 5P having a S content being less than the lower limit of the present invention range, the magnetic flux density was low.

(Ninth Experiment)

In the ninth experiment, the effect of the B content in the case of no S being contained was confirmed.

In the ninth experiment, first, slabs containing Si: 3.2 mass %, C: 0.06 mass %, acid-soluble Al: 0.027 mass %, N: 0.008 mass %, Mn: 0.12 mass %, Se: 0.008 mass %, and B having an amount listed in Table 6 (0 mass % to 0.0043 mass %), and a balance being composed of Fe and inevitable impurities were manufactured. Next, the slabs were heated at 1180° C., and were subjected to hot rolling. In the hot rolling, rough rolling was performed at 1100° C., annealing in which the slabs were held at 950° C. for 300 seconds was performed, and after that, finish rolling was performed at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.024 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 6.

TABLE 5

| | | COMPOSITION OF SILICON STEEL MATERIAL (MASS %) | | | | | | | | | | | | | | | MAGNETIC PROPERTY MAGNETIC FLUX DENSITY |
|---|---|---|---|---|---|---|---|---|---|---|---|---|---|---|---|---|---|
| | No. | Si | C | Al | N | Mn | S | B | Cr | Cu | Ni | P | Mo | Sn | Sb | Bi | B8 (T) |
| EXAMPLE | 5A | 3.3 | 0.06 | 0.028 | 0.008 | 0.1 | 0.006 | 0.002 | — | — | — | — | — | — | — | — | 1.917 |
| | 5B | 3.2 | 0.06 | 0.027 | 0.007 | 0.1 | 0.007 | 0.002 | 0.15 | — | — | — | — | — | — | — | 1.915 |
| | 5C | 3.4 | 0.06 | 0.025 | 0.008 | 0.1 | 0.008 | 0.0020 | — | 0.2 | — | — | — | — | — | — | 1.926 |
| | 5D | 3.3 | 0.06 | 0.027 | 0.008 | 0.1 | 0.006 | 0.0020 | — | — | 0.1 | — | — | — | — | — | 1.927 |
| | 5E | 3.3 | 0.06 | 0.024 | 0.007 | 0.1 | 0.006 | 0.0020 | — | — | 0.4 | — | — | — | — | — | 1.923 |
| | 5F | 3.3 | 0.06 | 0.027 | 0.009 | 0.1 | 0.007 | 0.0020 | — | — | 1.0 | — | — | — | — | — | 1.883 |
| | 5G | 3.4 | 0.06 | 0.028 | 0.007 | 0.1 | 0.007 | 0.0020 | — | — | — | 0.03 | — | — | — | — | 1.920 |
| | 5H | 3.2 | 0.06 | 0.027 | 0.008 | 0.1 | 0.006 | 0.0020 | — | — | — | — | 0.005 | — | — | — | 1.919 |
| | 5I | 3.3 | 0.06 | 0.028 | 0.008 | 0.1 | 0.007 | 0.0020 | — | — | — | — | — | 0.04 | — | — | 1.922 |
| | 5J | 3.3 | 0.06 | 0.025 | 0.008 | 0.1 | 0.006 | 0.0020 | — | — | — | — | — | — | 0.04 | — | 1.928 |
| | 5K | 3.3 | 0.06 | 0.024 | 0.009 | 0.1 | 0.008 | 0.0020 | — | — | — | — | — | — | — | 0.003 | 1.930 |
| | 5L | 3.2 | 0.06 | 0.030 | 0.008 | 0.1 | 0.006 | 0.0020 | 0.1 | — | — | 0.03 | — | 0.06 | — | — | 1.929 |
| | 5M | 3.8 | 0.06 | 0.027 | 0.008 | 0.1 | 0.007 | 0.0020 | 0.05 | 0.15 | 0.05 | 0.02 | — | 0.04 | — | — | 1.926 |
| | 5N | 3.3 | 0.06 | 0.028 | 0.006 | 0.1 | 0.006 | 0.0020 | 0.08 | — | — | — | 0.003 | 0.05 | — | 0.001 | 1.919 |
| | 5O | 2.8 | 0.06 | 0.022 | 0.008 | 0.1 | 0.006 | 0.0020 | — | — | — | — | — | — | — | — | 1.936 |
| COMPARATIVE EXAMPLE | 5P | 3.3 | 0.06 | 0.035 | 0.007 | 0.1 | 0.002 | 0.0020 | — | — | — | — | — | — | — | — | 1.593 |

TABLE 6

| | No. | B CONTENT (MASS %) | SLAB HEATING HEATING TEMPERATURE (° C.) | SLAB HEATING T2 (° C.) | SLAB HEATING T4 (° C.) | HOT ROLLING HOLDING TEMPERATURE (° C.) | HOT ROLLING HOLDING TIME (SEC) | NITRIDING TREATMENT N content (Mass %) | NITRIDING TREATMENT RIGHT SIDE OF INEQUATION (3) |
|---|---|---|---|---|---|---|---|---|---|
| COMPARATIVE EXAMPLE | 6A | 0 | 1180 | 1239 | 1176 | 950 | 300 | 0.024 | 0.014 |
| EXAMPLE | 6B | 0.0009 | 1180 | 1239 | 1176 | 950 | 300 | 0.024 | 0.0151 |
| | 6C | 0.0017 | 1180 | 1239 | 1176 | 950 | 300 | 0.024 | 0.0162 |
| | 6D | 0.0029 | 1180 | 1239 | 1176 | 950 | 300 | 0.024 | 0.0177 |
| | 6E | 0.0043 | 1180 | 1239 | 1176 | 950 | 300 | 0.024 | 0.0195 |

| | No. | NITRIDING TREATMENT RIGHT SIDE OF INEQUATION (4) | PRECIPITATES $B_{asBN}$ (MASS %) | PRECIPITATES $[B]-B_{asBN}$ (MASS %) | PRECIPITATES $S_{asMnSe}$ (MASS %) | MAGNETIC PROPERTY MAGNETIC FLUX DENSITY B8 (T) |
|---|---|---|---|---|---|---|
| COMPARATIVE EXAMPLE | 6A | 0.018 | 0 | 0 | 0.0044 | 1.894 |
| EXAMPLE | 6B | 0.0191 | 0.0008 | 0.0001 | 0.0043 | 1.917 |
| | 6C | 0.0202 | 0.0015 | 0.0002 | 0.0045 | 1.931 |
| | 6D | 0.0217 | 0.0025 | 0.0004 | 0.0046 | 1.927 |
| | 6E | 0.0235 | 0.0039 | 0.0004 | 0.0045 | 1.924 |

As listed in Table 6, in Comparative Example No. 6A having no B contained in the slab, the magnetic flux density was low, but in Examples No. 6B to No. 6E each having an appropriate amount of B contained in the slab, the good magnetic flux density was obtained.

(Tenth Experiment)

In the tenth experiment, the effects of the Mn content and the slab heating temperature in the case of no S being contained were confirmed.

In the tenth experiment, first, slabs containing Si: 3.3 mass %, C: 0.06 mass %, acid-soluble Al: 0.026 mass %, N: 0.007 mass %, Se: 0.009 mass %, B: 0.0015 mass %, and Mn having an amount listed in Table 7 (0.1 mass % to 0.21 mass %), and a balance being composed of Fe and inevitable impurities were manufactured. Next, the slabs were heated at 1200° C., and were subjected to hot rolling. In the hot rolling, for some of the samples (Examples No. 7A1 to No. 7A3), rough rolling was performed at 1100° C., annealing in which the slabs were held at 1000° C. for 500 seconds was performed, and after that, finish rolling was performed. In this manner, hot-rolled steel strips each having a thickness of 2.3 mm were obtained. On the other hand, for the other samples (Examples No. 7B1 to No. 7B3), rough rolling was performed at 1100° C., and after that, finish rolling was performed at 1020° C. without performing an annealing. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.022 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 7.

TABLE 7

| | No. | Mn CONTENT (MASS %) | SLAB HEATING HEATING TEMPERATURE (° C.) | HOT ROLLING HOLDING TEMPERATURE (° C.) | HOT ROLLING HOLDING TIME (SEC) | NITRIDING TREATMENT N CONTENT (MASS %) | PRECIPITATES $B_{asBN}$ (MASS %) | PRECIPITATES $[B]-B_{asBN}$ (MASS %) | PRECIPITATES $S_{asMnSe}$ (MASS %) | MAGNETIC PROPERTY MAGNETIC FLUX DENSITY B8 (T) |
|---|---|---|---|---|---|---|---|---|---|---|
| EXAMPLE | 7A1 | 0.10 | 1200 | 100 | 500 | 0.022 | 0.001 | 0.0006 | 0.0025 | 1.901 |
| | 7A2 | 0.15 | 1200 | 100 | 500 | 0.022 | 0.0012 | 0.0007 | 0.0038 | 1.927 |
| | 7A3 | 0.21 | 1200 | 100 | 500 | 0.022 | 0.0013 | 0.0007 | 0.0053 | 1.930 |
| COM-PARATIVE EXAMPLE | 7B1 | 0.10 | 1200 | — | — | 0.022 | 0.0004 | 0.0011 | 0.0018 | 1.736 |
| | 7B2 | 0.15 | 1200 | — | — | 0.022 | 0.0004 | 0.0011 | 0.0034 | 1.752 |
| | 7B3 | 0.21 | 1200 | — | — | 0.022 | 0.0004 | 0.0011 | 0.0045 | 1.776 |

As listed in Table 7, the good magnetic flux density was obtained in Examples No. 7A1 to No. 7A3 in each of which the slab was held at a predetermined temperature at an intermediate stage of the hot rolling, but the magnetic flux density was low in Comparative Examples No. 7B1 to No. 7B3 in each of which such holding was not performed.

(Eleventh Experiment)

In the eleventh experiment, influences of the holding temperature and the holding time in the hot rolling in the case of no S being contained were confirmed.

In the eleventh experiment, first, slabs containing Si: 3.2 mass %, C: 0.06 mass %, acid-soluble Al: 0.027 mass %, N: 0.006 mass %, Mn: 0.12 mass %, Se: 0.008 mass %, and B: 0.0017 mass %, and a balance being composed of Fe and inevitable impurities were manufactured. Next, the slabs were heated at 1200° C., then, annealing in which the slabs were held at 1050° C. to 700° C. for 100 seconds to 500 seconds was performed, and finish rolling was performed. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.021 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 8.

TABLE 8

| | | SLAB HEATING | | | HOT ROLLING | | NITRIDING | PRECIPITATES | | | MAGNETIC PROPERTY MAGNETIC |
|---|---|---|---|---|---|---|---|---|---|---|---|
| | No. | HEATING TEMPERATURE (° C.) | T2 (° C.) | T4 (° C.) | HOLDING TEMPERATURE (° C.) | HOLDING TIME (SEC) | TREATMENT N CONTENT (MASS %) | $B_{asBN}$ (MASS %) | $[B] - B_{asBN}$ (MASS %) | $Se_{asMnSe}$ (MASS %) | FLUX DENSITY B8 (T) |
| COMPARATIVE EXAMPLE | 8A | 1200 | 1239 | 1176 | 1050 | 500 | 0.021 | 0.0003 | 0.0014 | 0.0033 | 1.735 |
| EXAMPLE | 8B | 1200 | 1239 | 1176 | 1000 | 500 | 0.021 | 0.0009 | 0.0008 | 0.0042 | 1.925 |
| | 8C | 1200 | 1239 | 1176 | 900 | 500 | 0.021 | 0.0013 | 0.0004 | 0.0044 | 1.929 |
| | 8D | 1200 | 1239 | 1176 | 800 | 500 | 0.021 | 0.0011 | 0.0006 | 0.0043 | 1.923 |
| COMPARATIVE EXAMPLE | 8E | 1200 | 1239 | 1176 | 700 | 500 | 0.021 | 0.0003 | 0.0014 | 0.0032 | 1.777 |
| | 8F | 1200 | 1239 | 1176 | 900 | 100 | 0.021 | 0.0004 | 0.0013 | 0.0035 | 1.740 |
| | 8G | 1200 | 1239 | 1176 | 800 | 100 | 0.021 | 0.0003 | 0.0014 | 0.0034 | 1.736 |

As listed in Table 8, the good magnetic flux density was obtained in Examples No. 8B to No. 8D in each of which the slab was held at a predetermined temperature for a predetermined period of time at an intermediate stage of the hot rolling. But, the magnetic flux density was low in Comparative Examples No. 8A and No. 8E to No. 8G in each of which the holding temperature or the holding time was outside of the range of the present invention.

(Twelfth Experiment)

In the twelfth experiment, the effect of the N content after the nitriding treatment in the case of no S being contained was confirmed.

In the twelfth experiment, first, slabs containing Si: 3.3 mass %, C: 0.06 mass %, acid-soluble Al: 0.027 mass %, N: 0.008 mass %, Mn: 0.12 mass %, Se: 0.007 mass %, and B: 0.0016 mass %, a content of Ti that is an impurity being 0.0013 mass %, and a balance being composed of Fe and inevitable impurities were manufactured. Next, the slabs were heated at 1180° C., then annealing in which the slabs were held at 950° C. for 300 seconds was performed, and after that, finish rolling was performed. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.015 mass % to 0.022 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 9.

TABLE 9

| | | SLAB HEATING | | | HOT ROLLING | | NITRIDING TREATMENT | | |
|---|---|---|---|---|---|---|---|---|---|
| | No. | HEATING TEMPERATURE (° C.) | T2 (° C.) | T4 (° C.) | HOLDING TEMPERATURE (° C.) | HOLDING TIME (SEC) | N CONTENT (MASS %) | RIGHT SIDE OF INEQUATION (3) | RIGHT SIDE OF INEQUATION (4) |
| EXAMPLE | 9A | 1180 | 1227 | 1152 | 950 | 300 | 0.015 | 0.016 | 0.020 |
| | 9B | 1180 | 1227 | 1152 | 950 | 300 | 0.018 | 0.016 | 0.020 |
| | 9C | 1180 | 1227 | 1152 | 950 | 300 | 0.022 | 0.016 | 0.020 |

TABLE 9-continued

| | No. | PRECIPITATES $B_{asBN}$ (MASS %) | $[B] - B_{asBN}$ (MASS %) | $Se_{asMnSe}$ (MASS %) | MAGNETIC PROPERTY MAGNETIC FLUX DENSITY B8 (T) |
|---|---|---|---|---|---|
| EXAMPLE | 9A | 0.0015 | 0.0001 | 0.0042 | 1.883 |
| | 9B | 0.0015 | 0.0001 | 0.0042 | 1.915 |
| | 9C | 0.0015 | 0.0001 | 0.0042 | 1.926 |

As listed in Table 9, in Example No. 9C in which an N content after the nitriding treatment satisfied the relation of inequation (3) and the relation of inequation (4), the particularly good magnetic flux density was obtained. On the other hand, in Example No. 9B in which an N content after the nitriding treatment satisfied the relation of inequation (3) but did not satisfy the relation of inequation (4), the magnetic flux density was slightly lower than those in Example No. 9C. Further, in Example No. 9A in which an N content after the nitriding treatment did not satisfy the relation of inequation (3) and the relation of inequation (4), the magnetic flux density was slightly lower than those in Example No. 9B.

(Thirteenth Experiment)

In the thirteenth experiment, the effect of the components of the slab in the case of no S being contained was confirmed.

In the thirteenth experiment, first, slabs containing components listed in Table 10 and a balance being composed of Fe and inevitable impurities were manufactured. Next, the slabs were heated at 1200° C., then annealing in which the slabs were held at 950° C. for 300 seconds was performed, and after that, finish rolling was performed. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 860° C. for 100 seconds, and thereby decarburization-annealed steel strips were obtained. Subsequently, the decarburization-annealed steel strips were annealed in an ammonia containing atmosphere to increase nitrogen in the steel strips up to 0.023 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 10.

TABLE 10

| | No. | COMPOSITION OF SILICON STEEL MATERIAL (MASS %) Si | C | Al | N | Mn | Se | B | Cr | Cu | Ni | P | Mo | Sn | Sb | Bi | MAGNETIC PROPERTY MAGNETIC FLUX DENSITY B8 (T) |
|---|---|---|---|---|---|---|---|---|---|---|---|---|---|---|---|---|---|
| EXAMPLE | 10A | 3.3 | 0.06 | 0.027 | 0.008 | 0.15 | 0.006 | 0.002 | — | — | — | — | — | — | — | — | 1.917 |
| | 10B | 3.3 | 0.06 | 0.027 | 0.007 | 0.12 | 0.007 | 0.002 | 0.13 | — | — | — | — | — | — | — | 1.925 |
| | 10C | 3.4 | 0.06 | 0.025 | 0.008 | 0.12 | 0.007 | 0.002 | — | 0.22 | — | — | — | — | — | — | 1.926 |
| | 10D | 3.2 | 0.06 | 0.028 | 0.008 | 0.14 | 0.008 | 0.002 | — | — | 0.1 | — | — | — | — | — | 1.920 |
| | 10E | 3.4 | 0.06 | 0.027 | 0.007 | 0.11 | 0.006 | 0.002 | — | — | 0.4 | — | — | — | — | — | 1.916 |
| | 10F | 3.1 | 0.06 | 0.024 | 0.006 | 0.13 | 0.007 | 0.002 | — | — | 1.0 | — | — | — | — | — | 1.887 |
| | 10G | 3.3 | 0.06 | 0.029 | 0.007 | 0.10 | 0.008 | 0.002 | — | — | — | 0.04 | — | — | — | — | 1.927 |
| | 10H | 3.4 | 0.06 | 0.027 | 0.008 | 0.11 | 0.006 | 0.002 | — | — | — | — | 0.005 | — | — | — | 1.921 |
| | 10I | 3.1 | 0.06 | 0.028 | 0.008 | 0.13 | 0.007 | 0.002 | — | — | — | — | — | 0.06 | — | — | 1.927 |
| | 10J | 3.3 | 0.06 | 0.028 | 0.008 | 0.10 | 0.006 | 0.002 | — | — | — | — | — | — | 0.05 | — | 1.926 |
| | 10K | 3.3 | 0.06 | 0.030 | 0.009 | 0.10 | 0.008 | 0.002 | — | — | — | — | — | — | — | 0.002 | 1.929 |
| | 10L | 3.2 | 0.06 | 0.024 | 0.008 | 0.13 | 0.007 | 0.002 | 0.1 | — | — | 0.03 | — | 0.05 | — | — | 1.931 |
| | 10M | 3.7 | 0.06 | 0.027 | 0.008 | 0.10 | 0.007 | 0.002 | 0.08 | 0.17 | 0.05 | 0.02 | — | 0.07 | — | — | 1.928 |
| | 10N | 3.2 | 0.06 | 0.034 | 0.006 | 0.12 | 0.006 | 0.002 | 0.12 | — | — | — | 0.003 | 0.06 | — | 0.001 | 1.920 |
| | 10O | 2.8 | 0.06 | 0.021 | 0.007 | 0.10 | 0.006 | 0.002 | — | — | — | — | — | — | — | — | 1.935 |
| COMPARATIVE EXAMPLE | 10P | 3.1 | 0.06 | 0.030 | 0.009 | 0.10 | 0.002 | 0.002 | — | — | — | — | — | — | — | — | 1.547 |

As listed in Table 10, in Examples No. 10A to No. 10O each using the slab having the appropriate composition, the good magnetic flux density was obtained, but in Comparative Example No. 10P having a Se content being less than the lower limit of the present invention range, the magnetic flux density was low.

(Fourteenth Experiment)

In the fourteenth experiment, the effect of the B content in the case of S and Se being contained was confirmed.

In the fourteenth experiment, first, slabs containing Si: 3.2 mass %, C: 0.05 mass %, acid-soluble Al: 0.028 mass %, N: 0.008 mass %, Mn: 0.1 mass %, S: 0.006 mass %, Se: 0.006 mass %, and B having an amount listed in Table 11 (0 mass % to 0.0045 mass %), and a balance being composed of Fe and inevitable impurities were manufactured. Next, the slabs were heated at 1180° C., and were subjected to hot rolling. In the hot rolling, rough rolling was performed at 1100° C., annealing in which the slabs were held at 950° C. for 300 seconds was performed, and after that, finish rolling was performed at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.024 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 11.

TABLE 11

| | No. | B CONTENT (MASS %) | SLAB HEATING: HEATING TEMPERATURE (° C.) | SLAB HEATING: T1 (° C.) | SLAB HEATING: T2 (° C.) | HOT ROLLING: HOLDING TEMPERATURE (° C.) | HOT ROLLING: HOLDING TIME (SEC) | NITRIDING TREATMENT: N CONTENT (MASS %) | NITRIDING TREATMENT: RIGHT SIDE OF INEQUATION (3) | NITRIDING TREATMENT: RIGHT SIDE OF INEQUATION (4) |
|---|---|---|---|---|---|---|---|---|---|---|
| COMPARATIVE EXAMPLE | 11A | 0 | 1180 | 1206 | 1197 | 950 | 300 | 0.024 | 0.015 | 0.019 |
| EXAMPLE | 11B | 0.0009 | 1180 | 1206 | 1197 | 950 | 300 | 0.024 | 0.016 | 0.020 |
| | 11C | 0.0018 | 1180 | 1206 | 1197 | 950 | 300 | 0.024 | 0.017 | 0.021 |
| | 11D | 0.0028 | 1180 | 1206 | 1197 | 950 | 300 | 0.024 | 0.019 | 0.023 |
| | 11E | 0.0045 | 1180 | 1206 | 1197 | 950 | 300 | 0.024 | 0.020 | 0.024 |

| | No. | PRECIPITATES: $B_{asBN}$ (MASS %) | PRECIPITATES: [B] − $B_{asBN}$ (MASS %) | PRECIPITATES: $S_{asMnS}$ + 0.5 × $Se_{asMnSe}$ (MASS %) | MAGNETIC PROPERTY: MAGNETIC FLUX DENSITY B8 (T) |
|---|---|---|---|---|---|
| COMPARATIVE EXAMPLE | 11A | 0 | 0 | 0.005 | 1.904 |
| EXAMPLE | 11B | 0.0006 | 0.0003 | 0.005 | 1.918 |
| | 11C | 0.0015 | 0.0003 | 0.005 | 1.926 |
| | 11D | 0.0025 | 0.0003 | 0.005 | 1.925 |
| | 11E | 0.0040 | 0.0005 | 0.005 | 1.923 |

As listed in Table 11, in Comparative Example No. 11A having no B contained in the slab, the magnetic flux density was low, but in Examples No. 11B to No. 11E each having an appropriate amount of B contained in the slab, the good magnetic flux density was obtained.

(Fifteenth Experiment)

In the fifteenth experiment, the effects of the Mn content and the slab heating temperature in the case of S and Se being contained were confirmed.

In the fifteenth experiment, first, slabs containing Si: 3.3 mass %, C: 0.06 mass %, acid-soluble Al: 0.027 mass %, N: 0.006 mass %, S: 0.006 mass %, Se: 0.004 mass %, B: 0.0015 mass %, and Mn having an amount listed in Table 12 (0.05 mass % to 0.2 mass %), and a balance being composed of Fe and inevitable impurities were manufactured. Next, the slabs were heated at 1200° C., and were subjected to hot rolling. In the hot rolling, for some of the samples (Examples No. 12A1 to No. 12A4), rough rolling was performed at 1100° C., annealing in which the slabs were held at 1000° C. for 500 seconds was performed, and after that, finish rolling was performed. In this manner, hot-rolled steel strips each having a thickness of 2.3 mm were obtained. On the other hand, for the other samples (Examples No. 12B1 to No. 12B4), rough rolling was performed at 1100° C., and after that, finish rolling was performed at 1020° C. without performing an annealing. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.022 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 12.

TABLE 12

| | No. | Mn CONTENT (MASS %) | SLAB HEATING: HEATING TEMPERATURE (° C.) | HOT ROLLING: HOLDING TEMPERATURE (° C.) | HOT ROLLING: HOLDING TIME (SEC) | NITRIDING TREATMENT N CONTENT (MASS %) | PRECIPITATES: $B_{asBN}$ (MASS %) | PRECIPITATES: [B] − $B_{asBN}$ (MASS %) | PRECIPITATES: $S_{asMnS}$ + 0.5 × $Se_{asMnSe}$ (MASS %) | MAGNETIC PROPERTY: MAGNETIC FLUX DENSITY B8 (T) |
|---|---|---|---|---|---|---|---|---|---|---|
| EXAMPLE | 12A1 | 0.05 | 1200 | 1000 | 500 | 0.022 | 0.0008 | 0.0007 | 0.0022 | 1.893 |
| | 12A2 | 0.08 | 1200 | 1000 | 500 | 0.022 | 0.0010 | 0.0006 | 0.0025 | 1.902 |

TABLE 12-continued

| | No. | Mn CONTENT (MASS %) | SLAB HEATING: HEATING TEMPERATURE (° C.) | HOT ROLLING: HOLDING TEMPERATURE (° C.) | HOT ROLLING: HOLDING TIME (SEC) | NITRIDING TREATMENT N CONTENT (MASS %) | PRECIPITATES: $B_{asBN}$ (MASS %) | PRECIPITATES: [B] − $B_{asBN}$ (MASS %) | PRECIPITATES: $S_{asMnS}$ + 0.5 × $Se_{asMnSe}$ (MASS %) | MAGNETIC PROPERTY: MAGNETIC FLUX DENSITY B8 (T) |
|---|---|---|---|---|---|---|---|---|---|---|
| | 12A3 | 0.16 | 1200 | 1000 | 500 | 0.022 | 0.0012 | 0.0007 | 0.0038 | 1.919 |
| | 12A4 | 0.20 | 1200 | 1000 | 500 | 0.022 | 0.0013 | 0.0007 | 0.0053 | 1.925 |
| COMPARATIVE EXAMPLE | 12B1 | 0.05 | 1200 | — | — | 0.022 | 0.0003 | 0.0012 | 0.006 | 1.667 |
| | 12B2 | 0.08 | 1200 | — | — | 0.022 | 0.0004 | 0.0011 | 0.0018 | 1.698 |
| | 12B3 | 0.16 | 1200 | — | — | 0.022 | 0.0004 | 0.0011 | 0.0034 | 1.789 |
| | 12B4 | 0.20 | 1200 | — | — | 0.022 | 0.0004 | 0.0011 | 0.0045 | 1.792 |

As listed in Table 12, the good magnetic flux density was obtained in Examples No. 12A1 to No. 12A4 in each of which the slab was held at a predetermined temperature at an intermediate stage of the hot rolling, but the magnetic flux density was low in Comparative Examples No. 12B1 to No. 12B4 in each of which such holding was not performed.

(Sixteenth Experiment)

In the sixteenth experiment, influences of the holding temperature and the holding time in the hot rolling in the case of S and Se being contained were confirmed.

In the sixteenth experiment, first, slabs containing Si: 3.1 mass %, C: 0.06 mass %, acid-soluble Al: 0.026 mass %, N: 0.006 mass %, Mn: 0.12 mass %, S: 0.006 mass %, Se: 0.007 mass %, and B: 0.0015 mass % were manufactured. Next, the slabs were heated at 1200° C., then, annealing in which the slabs were held at 1050° C. to 700° C. for 100 seconds to 500 seconds was performed, and finish rolling was performed. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.021 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 13.

TABLE 13

| | No. | SLAB HEATING: Heating temperature (° C.) | SLAB HEATING: T1 (° C.) | SLAB HEATING: T2 (° C.) | HOT ROLLING: HOLDING TEMPERATURE (° C.) | HOT ROLLING: HOLDING TIME (SEC) | NITRIDING TREATMENT N CONTENT (MASS %) | PRECIPITATES: $B_{asBN}$ (MASS %) | PRECIPITATES: [B] − $B_{asBN}$ (MASS %) | PRECIPITATES: $S_{asMnS}$ + 0.5 × $Se_{asMnSe}$ (MASS %) | MAGNETIC PROPERTY: MAGNETIC FLUX DENSITY B8 (T) |
|---|---|---|---|---|---|---|---|---|---|---|---|
| COMPARATIVE EXAMPLE | 13A | 1200 | 1218 | 1227 | 1050 | 500 | 0.021 | 0.0004 | 0.0011 | 0.0024 | 1.705 |
| EXAMPLE | 13B | 1200 | 1218 | 1227 | 1000 | 500 | 0.021 | 0.001 | 0.0005 | 0.0026 | 1.918 |
| | 13C | 1200 | 1218 | 1227 | 900 | 500 | 0.021 | 0.0013 | 0.0002 | 0.0022 | 1.929 |
| | 13D | 1200 | 1218 | 1227 | 800 | 500 | 0.021 | 0.0012 | 0.0003 | 0.0021 | 1.927 |
| COMPARATIVE EXAMPLE | 13E | 1200 | 1218 | 1227 | 700 | 500 | 0.021 | 0.0004 | 0.0011 | 0.0017 | 1.678 |
| | 13F | 1200 | 1218 | 1227 | 900 | 100 | 0.021 | 0.0004 | 0.0011 | 0.0021 | 1.724 |
| | 13G | 1200 | 1218 | 1227 | 800 | 100 | 0.021 | 0.0003 | 0.0012 | 0.0018 | 1.798 |

As listed in Table 13, the good magnetic flux density was obtained in Examples No. 13B to No. 13D in each of which the slab was held at a predetermined temperature for a predetermined period of time at an intermediate stage of the hot rolling. But, the magnetic flux density was low in Comparative Examples No. 13A and No. 13E to No. 13G in each of which the holding temperature or the holding time was outside of the range of the present invention.

(Seventeenth Experiment)

In the seventeenth experiment, the effect of the N content after the nitriding treatment in the case of S and Se being contained was confirmed.

In the seventeenth experiment, first, slabs containing Si: 3.3 mass %, C: 0.06 mass %, acid-soluble Al: 0.028 mass %, N: 0.006 mass %, Mn: 0.15 mass %, S: 0.005 mass %, Se: 0.007 mass %, and B: 0.002 mass %, a content of Ti that is an impurity being 0.0014 mass %, and a balance being composed of Fe and inevitable impurities were manufactured. Next, the slabs were heated at 1200° C., then annealing in which the slabs were held at 950° C. for 300 seconds was performed, and after that, finish rolling was performed. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.014 mass % to 0.022 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 14.

TABLE 14

| | | SLAB HEATING | | | HOT ROLLING | | NITRIDING TREATMENT | | |
|---|---|---|---|---|---|---|---|---|---|
| | No. | HEATING TEMPERATURE (° C.) | T1 (° C.) | T2 (° C.) | HOLDING TEMPERATURE (° C.) | HOLDING TIME (SEC) | N CONTENT (MASS %) | RIGHT SIDE OF INEQUATION (3) | RIGHT SIDE OF INEQUATION (4) |
| EXAMPLE | 14A | 1200 | 1221 | 1248 | 950 | 300 | 0.014 | 0.018 | 0.022 |
| | 14B | 1200 | 1221 | 1248 | 950 | 300 | 0.020 | 0.018 | 0.022 |
| | 14C | 1200 | 1221 | 1248 | 950 | 300 | 0.022 | 0.018 | 0.022 |

| | | PRECIPITATES | | | MAGNETIC PROPERTY |
|---|---|---|---|---|---|
| | No. | $B_{asBN}$ (MASS %) | $[B] - B_{asBN}$ (MASS %) | $S_{asMnS} + 0.5 \times Se_{asMnSe}$ (MASS %) | MAGNETIC FLUX DENSITY B8 (T) |
| EXAMPLE | 14A | 0.0018 | 0.0002 | 0.0032 | 1.891 |
| | 14B | 0.0018 | 0.0002 | 0.0032 | 1.918 |
| | 14C | 0.0018 | 0.0002 | 0.0032 | 1.925 |

As listed in Table 14, in Example No. 14C in which an N content after the nitriding treatment satisfied the relation of inequation (3) and the relation of inequation (4), the particularly good magnetic flux density was obtained. On the other hand, in Example No. 14B in which an N content after the nitriding treatment satisfied the relation of inequation (3) but did not satisfy the relation of inequation (4), the magnetic flux density was slightly lower than those in Example No. 14C. Further, in Example No. 14A in which an N content after the nitriding treatment did not satisfy the relation of inequation (3) and the relation of inequation (4), the magnetic flux density was slightly lower than those in Example No. 14B.

(Eighteenth Experiment)

In the eighteenth experiment, the effect of the components of the slab in the case of S and Se being contained was confirmed.

In the eighteenth experiment, first, slabs containing components listed in Table 15 and a balance being composed of Fe and inevitable impurities were manufactured. Next, the slabs were heated at 1200° C., then annealing in which the slabs were held at 950° C. for 300 seconds was performed, and after that, finish rolling was performed. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 860° C. for 100 seconds, and thereby decarburization-annealed steel strips were obtained. Subsequently, the decarburization-annealed steel strips were annealed in an ammonia containing atmosphere to increase nitrogen in the steel strips up to 0.023 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 15.

TABLE 15

| | | COMPOSITION OF SILICON STEEL MATERIAL (MASS %) | | | | | | | | | | | | | | | | MAGNETIC PROPERTY MAGNETIC FLUX DENSITY |
|---|---|---|---|---|---|---|---|---|---|---|---|---|---|---|---|---|---|---|
| | No. | Si | C | Al | N | Mn | S | Se | B | Cr | Cu | Ni | P | Mo | Sn | Sb | Bi | B8 (T) |
| EXAMPLE | 15A | 3.3 | 0.06 | 0.028 | 0.008 | 0.12 | 0.005 | 0.007 | 0.002 | — | — | — | — | — | — | — | — | 1.919 |
| | 15B | 3.2 | 0.06 | 0.027 | 0.009 | 0.12 | 0.007 | 0.005 | 0.002 | 0.2 | — | — | — | — | — | — | — | 1.921 |
| | 15C | 3.4 | 0.06 | 0.025 | 0.008 | 0.12 | 0.006 | 0.007 | 0.002 | — | 0.2 | — | — | — | — | — | — | 1.925 |
| | 15D | 3.3 | 0.06 | 0.027 | 0.008 | 0.12 | 0.006 | 0.007 | 0.002 | — | — | 0.1 | — | — | — | — | — | 1.924 |
| | 15E | 3.3 | 0.06 | 0.024 | 0.007 | 0.12 | 0.006 | 0.007 | 0.002 | — | — | 0.4 | — | — | — | — | — | 1.917 |
| COMPARATIVE EXAMPLE | 15F | 3.1 | 0.06 | 0.027 | 0.009 | 0.12 | 0.006 | 0.007 | 0.002 | — | — | 1.3 | — | — | — | — | — | 1.694 |
| EXAMPLE | 15G | 3.4 | 0.06 | 0.028 | 0.007 | 0.12 | 0.006 | 0.007 | 0.002 | — | — | — | 0.03 | — | — | — | — | 1.924 |
| | 15H | 3.2 | 0.06 | 0.027 | 0.008 | 0.12 | 0.006 | 0.007 | 0.002 | — | — | — | — | 0.005 | — | — | — | 1.923 |
| | 15I | 3.3 | 0.06 | 0.028 | 0.008 | 0.12 | 0.006 | 0.007 | 0.002 | — | — | — | — | — | 0.04 | — | — | 1.925 |
| | 15J | 3.3 | 0.06 | 0.025 | 0.008 | 0.12 | 0.006 | 0.007 | 0.002 | — | — | — | — | — | — | 0.04 | — | 1.923 |
| | 15K | 3.3 | 0.06 | 0.024 | 0.009 | 0.12 | 0.006 | 0.007 | 0.002 | — | — | — | — | — | — | — | 0.003 | 1.927 |

TABLE 15-continued

| | | COMPOSITION OF SILICON STEEL MATERIAL (MASS %) | | | | | | | | | | | | | | | | MAGNETIC PROPERTY MAGNETIC FLUX DENSITY |
|---|---|---|---|---|---|---|---|---|---|---|---|---|---|---|---|---|---|---|
| | No. | Si | C | Al | N | Mn | S | Se | B | Cr | Cu | Ni | P | Mo | Sn | Sb | Bi | B8 (T) |
| | 15L | 3.2 | 0.06 | 0.030 | 0.008 | 0.12 | 0.006 | 0.004 | 0.002 | 0.1 | — | — | 0.03 | — | 0.06 | — | — | 1.931 |
| | 15M | 3.8 | 0.06 | 0.027 | 0.008 | 0.12 | 0.005 | 0.005 | 0.002 | 0.1 | 0.15 | 0.05 | 0.02 | — | 0.04 | — | — | 1.932 |
| | 15N | 3.3 | 0.06 | 0.028 | 0.009 | 0.12 | 0.006 | 0.004 | 0.002 | 0.1 | — | — | — | 0.003 | 0.05 | — | 0.001 | 1.923 |
| | 15O | 2.8 | 0.06 | 0.022 | 0.008 | 0.12 | 0.004 | 0.007 | 0.002 | — | — | — | — | — | — | — | — | 1.937 |
| COMPARATIVE EXAMPLE | 15P | 3.3 | 0.06 | 0.035 | 0.007 | 0.12 | 0.001 | 0.0003 | 0.002 | — | — | — | — | — | — | — | — | 1.601 |

As listed in Table 15, in Examples No. 15A to No. 15E, and No. 15G to No. 15O each using the slab having the appropriate composition, the good magnetic flux density was obtained, but in Comparative Example No. 15F having a Ni content being higher than the upper limit of the present invention range, and in Comparative Example No. 15P having a S content and a Se content being less than the lower limit of the present invention range, the magnetic flux density was low.

(Nineteenth Experiment)

In the nineteenth experiment, the effect of the nitriding treatment in the case of S and Se being contained was confirmed.

In the nineteenth experiment, first, slabs containing Si: 3.2 mass %, C: 0.06 mass %, acid-soluble Al: 0.027 mass %, N: 0.007 mass %, Mn: 0.14 mass %, S: 0.006 mass %, Se: 0.005 mass %, and B: 0.0015 mass %, and a balance being composed of Fe and inevitable impurities were manufactured. Next, the slabs were heated at 1200° C., and were subjected to hot rolling. In the hot rolling, rough rolling was performed, annealing in which the slabs were held at 950° C. for 300 seconds was performed, and after that, finish rolling was performed. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained.

Thereafter, as for a sample of Comparative Example No. 16A, decarburization annealing was performed in a moist atmosphere gas at 830° C. for 100 seconds, and thereby a decarburization-annealed steel strip was obtained. Further, as for a sample of Example No. 16B, decarburization annealing was performed in a moist atmosphere gas at 830° C. for 100 seconds, and further annealing was performed in an ammonia containing atmosphere, and thereby a decarburization-annealed steel strip having an N content of 0.022 mass % was obtained. Further, as for a sample of Example No. 16C, decarburization annealing was performed in a moist atmosphere gas at 860° C. for 100 seconds, and thereby a decarburization-annealed steel strip having an N content of 0.022 mass % was obtained. In this manner, three types of the decarburization-annealed steel strips were obtained.

Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 16.

TABLE 16

| | No. | APPLICATION OR NO APPLICATION OF NITRIDING TREATMENT | SLAB HEATING HEATING TEMPERATURE (° C.) | T1 (° C.) | T2 (° C.) | NITRIDING TREATMENT N CONTENT (MASS %) | RIGHT SIDE OF INEQUATION (3) | RIGHT SIDE OF INEQUATION (4) |
|---|---|---|---|---|---|---|---|---|
| COMPARATIVE EXAMPLE | 16A | NOT APPLIED | 1200 | 1228 | 1211 | 0.007 | 0.016 | 0.020 |
| EXAMPLE | 16B | APPLIED | 1200 | 1228 | 1211 | 0.021 | 0.016 | 0.020 |
| | 16C | APPLIED | 1200 | 1228 | 1211 | 0.021 | 0.016 | 0.020 |

| | No. | PRECIPITATES $B_{asBN}$ (MASS %) | [B] − $B_{asBN}$ (MASS %) | $S_{asMnS}$ + 0.5 × $Se_{asMnSe}$ (MASS %) | MAGNETIC PROPERTY MAGNETIC FLUX DENSITY B8 (T) |
|---|---|---|---|---|---|
| COMPARATIVE EXAMPLE | 16A | 0.0014 | 0.0001 | 0.006 | 1.612 |
| EXAMPLE | 16B | 0.0014 | 0.0001 | 0.006 | 1.934 |
| | 16C | 0.0014 | 0.0001 | 0.006 | 1.931 |

As listed in Table 16, in Example No. 16B in which the nitriding treatment was performed after the decarburization annealing, and Example No. 16C in which the nitriding treatment was performed during the decarburization annealing, the good magnetic flux density was obtained. However, in Comparative Example No. 16A in which no nitriding treatment was performed, the magnetic flux density was low. Incidentally, the numerical value in the section of "NITRIDING TREATMENT" of Comparative Example No. 16A in Table 16 is a value obtained from the composition of the decarburization-annealed steel strip.

Industrial Applicability

The present invention can be utilized in, for example, an industry of manufacturing electrical steel sheets and an industry in which electrical steel sheets are used.

The invention claimed is:

1. A manufacturing method of a grain-oriented electrical steel sheet, comprising:

hot rolling a silicon steel material so as to obtain a hot-rolled steel strip, the silicon steel material containing Si: 0.8 mass % to 7 mass %, acid-soluble Al: 0.01 mass % to 0.065 mass %, N: 0.004 mass % to 0.012 mass %, Mn: 0.05 mass % to 1 mass %, Ti: 0.004 mass % or less and B: 0.0005 mass % to 0.0080 mass %, the silicon steel material further containing at least one element selected from a group consisting of S and Se being 0.003 mass % to 0.015 mass % in total amount, a C content being 0.085 mass % or less, and a balance being composed of Fe and inevitable impurities;

annealing the hot-rolled steel strip so as to obtain an annealed steel strip;

cold rolling the annealed steel strip one time or more so as to obtain a cold-rolled steel strip;

decarburization annealing the cold-rolled steel strip so as to obtain a decarburized-annealed steel strip in which primary recrystallization is caused;

coating an annealing separating agent containing MgO as its main component on the decarburized-annealed steel strip; and causing secondary recrystallization by finish annealing the coated decarburized-annealed steel strip, wherein the method further comprises performing a nitriding treatment in which an N content of the decarburized-annealed steel strip is increased between start of the decarburization annealing and occurrence of the secondary recrystallization in the finish annealing, wherein the hot rolling comprises:

holding the silicon steel material in a temperature range from 1000° C. to 800° C. for 300 seconds or longer; and then performing finish rolling.

2. The manufacturing method of the grain-oriented electrical steel sheet according to claim 1, further comprising heating the silicon steel material at a predetermined temperature which is a temperature T1 (° C.) or lower before the hot rolling, in a case when no Se is contained in the silicon steel material, the temperature T1 is expressed by equation (1) below $$T1=14855/(6.82-\log([Mn]\times[S]))-273 \quad (1)$$

wherein, [Mn] represents a Mn content (mass %) of the silicon steel material, and [S] represents an S content (mass %) of the silicon steel material.

3. The manufacturing method of the grain-oriented electrical steel sheet according to claim 1, further comprising heating the silicon steel material at a predetermined temperature which is a temperature T2 (° C.) or lower before the hot rolling, in a case when no S is contained in the silicon steel material, the temperature T2 is expressed by equation (2) below $$T2=10733/(4.08-\log([Mn]\times[Se]))-273 \quad (2)$$

wherein, [Mn] represents a Mn content (mass %) of the silicon steel material, and [Se] represents an Se content (mass %) of the silicon steel material.

4. The manufacturing method of the grain-oriented electrical steel sheet according to claim 1, further comprising heating the silicon steel material at a predetermined temperature which is lower than each of a temperature T1 (° C.) and a temperature T2 (° C.) or lower before the hot rolling, in a case when S and Se are contained in the silicon steel material, the temperature T1 is being expressed by equation (1) below, and the temperature T2 is expressed by equation (2) below $$T1=14855/(6.82-\log([Mn]\times[S]))-273 \quad (1)$$

$$T2=10733/(4.08-\log([Mn]\times[Se]))-273 \quad (2)$$

wherein, [Mn] represents a Mn content (mass %) of the silicon steel material, [S] represents an S content (mass %) of the silicon steel material, and [Se] represents an Se content (mass %) of the silicon steel material.

5. The manufacturing method of the grain-oriented electrical steel sheet according to claim 1, wherein the nitriding treatment is performed under a condition that an N content [N] of a steel strip obtained after the nitriding treatment satisfies equation (3) below $$[N]\geqq 14/27[Al]+14/11[B]+14/47[Ti] \quad (3)$$

wherein, [N] represents the N content (mass %) of the steel strip obtained after the nitriding treatment, [Al] represents an acid-soluble Al content (mass %) of the steel strip obtained after the nitriding treatment, [B] represents a B content (mass %) of the steel strip obtained after the nitriding treatment, and [Ti] represents a Ti content (mass %) of the steel strip obtained after the nitriding treatment.

6. The manufacturing method of the grain-oriented electrical steel sheet according to claim 2, wherein the nitriding treatment is performed under a condition that an N content [N] of a steel strip obtained after the nitriding treatment satisfies equation (3) below $$[N]\geqq 14/27[Al]+14/11[B]+14/47[Ti] \quad (3)$$

wherein, [N] represents the N content (mass %) of the steel strip obtained after the nitriding treatment, [Al] represents an acid-soluble Al content (mass %) of the steel strip obtained after the nitriding treatment, [B] represents a B content (mass %) of the steel strip obtained after the nitriding treatment, and [Ti] represents a Ti content (mass %) of the steel strip obtained after the nitriding treatment.

7. The manufacturing method of the grain-oriented electrical steel sheet according to claim 3, wherein the nitriding treatment is performed under a condition that an N content [N] of a steel strip obtained after the nitriding treatment satisfies equation (3) below $$[N]\geqq 14/27[Al]+14/11[B]+14/47[Ti] \quad (3)$$

wherein, [N] represents the N content (mass %) of the steel strip obtained after the nitriding treatment, [Al] represents an acid-soluble Al content (mass %) of the steel strip obtained after the nitriding treatment, [B] represents a B content (mass %) of the steel strip obtained after the nitriding treatment, and [Ti] represents a Ti content (mass %) of the steel strip obtained after the nitriding treatment.

8. The manufacturing method of the grain-oriented electrical steel sheet according to claim 4, wherein the nitriding treatment is performed under a condition that an N content [N] of a steel strip obtained after the nitriding treatment satisfies equation (3) below $$[N] \geqq 14/27[Al]+14/11[B]+14/47[Ti] \quad (3)$$

wherein, [N] represents the N content (mass %) of the steel strip obtained after the nitriding treatment, [Al] represents an acid-soluble Al content (mass %) of the steel strip obtained after the nitriding treatment, [B] represents a B content (mass %) of the steel strip obtained after the nitriding treatment, and [Ti] represents a Ti content (mass %) of the steel strip obtained after the nitriding treatment.

9. The manufacturing method of the grain-oriented electrical steel sheet according to claim 1, wherein the nitriding treatment is performed under a condition that an N content [N] of a steel strip obtained after the nitriding treatment satisfies equation (4) below $$[N] \geqq 2/3[Al]+14/11[B]+14/47[Ti] \quad (4)$$

wherein, [N] represents the N content (mass %) of the steel strip obtained after the nitriding treatment, [Al] represents an acid-soluble Al content (mass %) of the steel strip obtained after the nitriding treatment, [B] represents a B content (mass %) of the steel strip obtained after the nitriding treatment, and [Ti] represents a Ti content (mass %) of the steel strip obtained after the nitriding treatment.

10. The manufacturing method of the grain-oriented electrical steel sheet according to claim 2, wherein the nitriding treatment is performed under a condition that an N content [N] of a steel strip obtained after the nitriding treatment satisfies equation (4) below $$[N] \geqq 2/3[Al]+14/11[B]+14/47[Ti] \quad (4)$$

wherein, [N] represents the N content (mass %) of the steel strip obtained after the nitriding treatment, [Al] represents an acid-soluble Al content (mass %) of the steel strip obtained after the nitriding treatment, [B] represents a B content (mass %) of the steel strip obtained after the nitriding treatment, and [Ti] represents a Ti content (mass %) of the steel strip obtained after the nitriding treatment.

11. The manufacturing method of the grain-oriented electrical steel sheet according to claim 3, wherein the nitriding treatment is performed under a condition that an N content [N] of a steel strip obtained after the nitriding treatment satisfies equation (4) below $$[N] \geqq 2/3[Al]+14/11[B]+14/47[Ti] \quad (4)$$

wherein, [N] represents the N content (mass %) of the steel strip obtained after the nitriding treatment, [Al] represents an acid-soluble Al content (mass %) of the steel strip obtained after the nitriding treatment, [B] represents a B content (mass %) of the steel strip obtained after the nitriding treatment, and [Ti] represents a Ti content (mass %) of the steel strip obtained after the nitriding treatment.

12. The manufacturing method of the grain-oriented electrical steel sheet according to claim 4, wherein the nitriding treatment is performed under a condition that an N content [N] of a steel strip obtained after the nitriding treatment satisfies equation (4) below $$[N] \geqq 2/3[Al]+14/11[B]+14/47[Ti] \quad (4)$$

wherein, [N] represents the N content (mass %) of the steel strip obtained after the nitriding treatment, [Al] represents an acid-soluble Al content (mass %) of the steel strip obtained after the nitriding treatment, [B] represents a B content (mass %) of the steel strip obtained after the nitriding treatment, and [Ti] represents a Ti content (mass %) of the steel strip obtained after the nitriding treatment.

13. The manufacturing method of the grain-oriented electrical steel sheet according to claim 1, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

14. The manufacturing method of the grain-oriented electrical steel sheet according to claim 2, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

15. The manufacturing method of the grain-oriented electrical steel sheet according to claim 3, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

16. The manufacturing method of the grain-oriented electrical steel sheet according to claim 4, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

17. The manufacturing method of the grain-oriented electrical steel sheet according to claim 5, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

18. The manufacturing method of the grain-oriented electrical steel sheet according to claim 6, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

19. The manufacturing method of the grain-oriented electrical steel sheet according to claim 7, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

20. The manufacturing method of the grain-oriented electrical steel sheet according to claim 8, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

21. The manufacturing method of the grain-oriented electrical steel sheet according to claim 9, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

22. The manufacturing method of the grain-oriented electrical steel sheet according to claim 10, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

23. The manufacturing method of the grain-oriented electrical steel sheet according to claim 11, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

24. The manufacturing method of the grain-oriented electrical steel sheet according to claim 12, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

25. The manufacturing method of the grain-oriented electrical steel sheet according to claim 1, wherein BN precipitates during the hot rolling.

* * * * *

UNITED STATES PATENT AND TRADEMARK OFFICE

CERTIFICATE OF CORRECTION

PATENT NO. : 8,409,368 B2
APPLICATION NO. : 13/261144
DATED : April 2, 2013
INVENTOR(S) : Yoshiyuki Ushigami et al.

It is certified that error appears in the above-identified patent and that said Letters Patent is hereby corrected as shown below:

In the Specification

Column 3, line 36, change "inequation (3)" to -- equation (3) --;

Column 3, line 38, change "[N] □ 14/27 [A1] + 14/11 [B] +14/47 [Ti]" to
-- [N] ≧ 14/27 [A1] + 14/11 [B] + 14/47 [Ti] --;

Column 3, line 52, change "inequation (4)" to -- equation (4) --;

Column 3, line 54, change "[N] □ 2/3[Al] + 14/11[B] + 14/47[Ti]" to
-- [N] ≧2/3[Al] + 14/11[B] + 14/47[Ti] --;

Column 11, line 22, change "a y transformation" to -- a γ transformation --;

Column 12, line 14, change "inequation (5)" to -- equation (5) --;

Column 12, line 22, change "[Mn]/([S]+[Se])≧4" to -- [Mn] /([S]) + [Se]) ≧4 --;

Column 13, line 36, change "inequations (6) to (8)" to -- equations (6) to (8) --;

Column 13, line 38, change "$B_{asBN}$ □ 0.0005" to -- $B_{asBN}$ ≧0.0005 --;

Column 13, line 40, change "[B] – $B_{asBN}$ □ 0.001" to -- [B] – $B_{asBN}$ ≦0.001 --;

Column 13, line 42, change "$S_{asMnS}$ + 0.5 × $Se_{anMnSe}$ □ 0.002" to -- $S_{asMnS}$ + 0.5 × $Se_{asMnSe}$ ≧0.002 --;

Column 13, line 49, change "inequation (6)" to -- equation (6) --;

Signed and Sealed this
Twenty-fourth Day of December, 2013

Margaret A. Focarino

Margaret A. Focarino
*Commissioner for Patents of the United States Patent and Trademark Office*

Column 13, line 50, change “inequation (7)” to -- equation (7) --;

Column 13, line 60, change “inequation (8)” to -- equation (8) --;

Column 13, line 61, change “inequation (7)” to -- equation (7) --;

Column 13, line 66, change “inequation (6)” to -- equation (6) --;

Column 13, lines 66-67, change “inequation (8)” to -- equation (8) --;

Column 16, line 5, change “inequation (3)” to -- equation (3) --;

Column 16, line 7, change “inequation (4)” to -- equation (4) --;

Column 16, line 7, change “Inequation (3) and inequation” to -- Equation (3) and equation --;

Column 16, line 11, change “[N] □ 14/27 [A1] + 14/11 [B] +14/47 [Ti]” to
-- [N] ≧ 14/27 [A1] + 14/11 [B] + 14/47 [Ti] --;

Column 16, line 13, change “[N] □ 2/3[A1] + 14/11[B] + 14/47[Ti]” to
-- [N] ≧2/3[A1] + 14/11[B] + 14/47[Ti] --;

Column 18, Table 1, under NITRIDING TREATMENT column, change “RIGHT SIDE OF INEQUATION (3)” to -- RIGHT SIDE OF EQUATION (3) --;

Column 18, Table 1, under NITRIDING TREATMENT column, change “RIGHT SIDE OF INEQUATION (4)” to -- RIGHT SIDE OF EQUATION (4) --;

Column 20, Table 4, under NITRIDING TREATMENT column, change “RIGHT SIDE OF INEQUATION (3)” to -- RIGHT SIDE OF EQUATION (3) --;

Column 20, Table 4, under NITRIDING TREATMENT column, change “RIGHT SIDE OF INEQUATION (4)” to -- RIGHT SIDE OF EQUATION (4) --;

Column 21, line 3, change “inequation (3)” to -- equation (3) --;

Column 21, line 3, change “inequation (4)” to -- equation (4) --;

Column 21, line 6, change “inequation (3)” to -- equation (3) --;

Column 21, line 7, change “inequation (4)” to -- equation (4) --;

Column 21, line 10, change “inequation (3)” to -- equation (3) --;

Column 21, line 11, change “inequation (4)” to -- equation (4) --;

Column 23, Table 7, Example No. 7A1, under HOLDING TEMPERATURE (°C) column, change “100” to -- 1000 --;

Column 23, Table 7, Example No. 7A2, under HOLDING TEMPERATURE (°C) column, change “100” to -- 1000 --;

Column 23, Table 7, Example No. 7A3, under HOLDING TEMPERATURE (°C) column, change “100” to --1000 --;

Column 24, Table 6, under NITRIDING TREATMENT column, change “RIGHT SIDE OF INEQUATION (3)” to -- RIGHT SIDE OF EQUATION (3) --;

Column 26, Table 9, under NITRIDING TREATMENT column, change “RIGHT SIDE OF INEQUATION (3)” to -- RIGHT SIDE OF EQUATION (3) --;

Column 26, Table 9, under NITRIDING TREATMENT column, change “RIGHT SIDE OF INEQUATION (4)” to -- RIGHT SIDE OF EQUATION (4) --;

Column 27, line 15, change “inequation (3)” to -- equation (3) --;

Column 27, line 15, change “inequation (4)” to -- equation (4) --;

Column 27, line 18, change “inequation (3)” to -- equation (3) --;

Column 27, line 43, change “inequation (4)” to -- equation (4) --;

Column 27, lines 46-47, change “inequation (3)” to -- equation (3) --;

Column 27, line 47, change “inequation (4)” to -- equation (4) --;

Column 30, Table 11, under NITRIDING TREATMENT column, change “RIGHT SIDE OF INEQUATION (3)” to -- RIGHT SIDE OF EQUATION (3) --;

Column 30, Table 11, under NITRIDING TREATMENT column, change “RIGHT SIDE OF INEQUATION (4)” to -- RIGHT SIDE OF EQUATION (4) --;

Column 34, Table 14, under NITRIDING TREATMENT column, change “RIGHT SIDE OF INEQUATION (3)” to -- RIGHT SIDE OF EQUATION (3) --;

Column 34, Table 14, under NITRIDING TREATMENT column, change “RIGHT SIDE OF INEQUATION (4)” to -- RIGHT SIDE OF EQUATION (4) --;

Column 33, line 34, change “inequation (3)” to -- equation (3) --;

Column 33, line 34, change “inequation (4)” to -- equation (4) --;

Column 33, line 37, change “inequation (3)” to -- equation (3) --;

Column 33, line 38, change “inequation (4)” to -- equation (4) --;

Column 33, line 41, change “inequation (3)” to -- equation (3) --;

Column 33, line 42, change “inequation (4)” to -- equation (4) --;

Column 36, Table 16, under N1TRJDING TREATMENT column, change “RIGHT SIDE OF INEQUATION (3)” to -- RIGHT SIDE OF EQUATION (3) --;

Column 36, Table 16, under NITRIDING TREATMENT column, change “RIGHT SIDE OF INEQUATION (4)” to -- RIGHT SIDE OF EQUATION (4) --;

Column 38, lines 7-8, change “and a temperature T2 (°C.) or lower” to -- and T2(°C.) --;

Column 38, line 10, change “is being expressed” to -- is expressed --.